US011118328B2

(12) United States Patent
Shimizu et al.

(10) Patent No.: US 11,118,328 B2
(45) Date of Patent: Sep. 14, 2021

(54) CONSTRUCTION MACHINE

(71) Applicant: Hitachi Construction Machinery Co., Ltd., Tokyo (JP)

(72) Inventors: Juri Shimizu, Tokyo (JP); Kenji Hiraku, Tsuchiura (JP); Hiromasa Takahashi, Tsuchiura (JP); Teppei Saitou, Tsuchiura (JP); Shouhei Sugiki, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/056,288

(22) PCT Filed: May 20, 2019

(86) PCT No.: PCT/JP2019/019879

§ 371 (c)(1),
(2) Date: Nov. 17, 2020

(87) PCT Pub. No.: WO2020/003811

PCT Pub. Date: Jan. 2, 2020

(65) Prior Publication Data

US 2021/0246634 A1 Aug. 12, 2021

(30) Foreign Application Priority Data

Jun. 25, 2018 (JP) ..... JP2018-119638

(51) Int. Cl.
*E02F 9/22* (2006.01)
*F15B 11/17* (2006.01)
*F15B 11/16* (2006.01)

(52) U.S. Cl.
CPC ..... *E02F 9/2296* (2013.01); *E02F 9/2235* (2013.01); *E02F 9/2267* (2013.01);
(Continued)

(58) Field of Classification Search
None
See application file for complete search history.

(56) References Cited

U.S. PATENT DOCUMENTS 4,531,366 A * 7/1985 Moriya ..... E02F 9/2232 417/216
8,266,903 B2 * 9/2012 Kowatari ..... F04B 17/05 60/449

(Continued)

FOREIGN PATENT DOCUMENTS

JP 2010-276126 A 12/2010
JP 2015-98938 A 5/2015

(Continued)

OTHER PUBLICATIONS

International Preliminary Report on Patentability (PCT/IB/338 & PCT/IB/373) issued in PCT Application No. PCT/JP2019/019879 dated Jan. 7, 2021 including English translation of document (Japanese-language Written Opinion (PCT/ISA/237), filed on Nov. 17, 2020) (six) 6 pages).

(Continued)

*Primary Examiner* — Michael Leslie
(74) *Attorney, Agent, or Firm* — Crowell & Moring LLP

(57) ABSTRACT

An object of the present invention is to provide a construction machine capable of suppressing lugging down of an engine irrespective of contents of operation of an operator and the load state of a hydraulic actuator. A controller 50 includes: a demanded torque estimating section 50*c* configured to estimate demanded torque as torque demanded from an engine 9 by the first hydraulic pump on the basis of a demanded velocity of a first hydraulic actuator 1 and a load pressure on the first hydraulic actuator; a demanded velocity limiting section 50*d* configured to, in a case in which a demanded torque change rate as a change rate of the demanded torque exceeds a predetermined change rate, limit the demanded velocity such that the demanded torque change rate becomes equal to or lower than the predetermined change rate; and a command calculating section 50*e* configured to calculate a delivery flow rate of the first (Continued)

hydraulic pump on the basis of the demanded velocity of the first hydraulic actuator, the demanded velocity being limited by the demanded velocity limiting section.

7 Claims, 13 Drawing Sheets

(52) U.S. Cl.
CPC ..... *E02F 9/2289* (2013.01); *E02F 9/2292* (2013.01); *F15B 11/165* (2013.01); *F15B 11/17* (2013.01); *F15B 2211/20576* (2013.01); *F15B 2211/45* (2013.01); *F15B 2211/633* (2013.01); *F15B 2211/6313* (2013.01); *F15B 2211/6655* (2013.01); *F15B 2211/75* (2013.01)

(56) References Cited

U.S. PATENT DOCUMENTS 8,347,619 B2 * 1/2013 Kim ..... F04B 17/05 60/428
9,371,898 B2 * 6/2016 Schulte ..... B60W 30/00
9,783,960 B2 * 10/2017 Shimizu ..... E02F 9/2278
10,106,957 B2 * 10/2018 Kim ..... F02D 29/04
10,184,225 B2 * 1/2019 Hiraku ..... E02F 9/2292
10,889,964 B2 * 1/2021 Shimizu ..... F15B 15/02
2010/0303642 A1 12/2010 Nanjo et al.
2020/0080551 A1 * 3/2020 Caldwell ..... F02D 29/04

FOREIGN PATENT DOCUMENTS

JP 2017-106251 A 6/2017
WO WO 98/06936 A1 2/1998

OTHER PUBLICATIONS

International Search Report (PCT/ISA/210) issued in PCT Application No. PCT/JP2019/019879 dated Aug. 13, 2019 with English translation (two (2) pages).
Japanese-language Written Opinion (PCT/ISA/237) issued in PCT Application No. PCT/JP2019/019879 dated Aug. 13, 2019 (two (2) pages).

* cited by examiner

CONSTRUCTION MACHINE

TECHNICAL FIELD

The present invention relates to a construction machine including a hydraulic drive system that supplies pressure liquid to a hydraulic actuator by a hydraulic pump driven by an engine.

BACKGROUND ART

Recently, in order to reduce a fuel consumption rate by reducing restrictor elements within a hydraulic circuit that drives a hydraulic actuator such as a hydraulic cylinder in a construction machine such as a hydraulic excavator, development has been underway for a hydraulic circuit connected so as to feed hydraulic operating fluid from a hydraulic pump to a hydraulic actuator, and return the hydraulic operating fluid after work is performed in the hydraulic actuator to the hydraulic pump without returning the hydraulic operating fluid to a tank (which hydraulic circuit will hereinafter be a hydraulic closed circuit).

In a case where the hydraulic pump is driven with an engine as a prime mover, load horsepower imposed on the engine needs to be controlled so as not to stop the engine under excess load while effectively using the output power of the engine. There is Patent Document 1, for example, that discloses a conventional technology related to hydraulic pump horsepower control.

Patent Document 1 describes a controller for a work machine, the controller being included in the work machine having a variable displacement hydraulic pump driven by an engine and a plurality of actuators supplied with hydraulic operating fluid from the hydraulic pump, the controller including: an input unit (control lever) that receives operation to input actuating commands for the respective actuators; a storage unit that stores horsepower information that associates, with each operation content identified by an actuator as an operation target among the actuators and the direction of an operation performed on this actuator, an operation amount thereof and an upper limit value of absorption horsepower of the hydraulic pump; an operating horsepower determining section that determines an upper limit value of the absorption horsepower for each actuator by using the horsepower information stored in the storage unit when an actuating command for at least one actuator is inputted by the input unit; a high-level selecting section that selects a largest absorption horsepower upper limit value among absorption horsepower upper limit values determined by the operating horsepower determining section; and a displacement adjusting section that adjusts the displacement of the hydraulic pump so as to produce horsepower equal to or less than the absorption horsepower selected by the high-level selecting section, in which horsepower information related to at least one operation content in the horsepower information stored in the storage unit has a characteristic of changing in upper limit value of the absorption horsepower according to a change in the operation amount of the input unit.

PRIOR ART DOCUMENT

Patent Document

Patent Document 1: JP-2010-276126-A

SUMMARY OF THE INVENTION

Problems to be Solved by the Invention

The controller for a work machine as described in Patent Document 1 can control a load on the engine and suppress a problem such as an engine stalling by setting the upper limit value of the absorption horsepower of the hydraulic pump according to the operation amount and operation direction of the control lever. However, consideration is not given to the operation speed of the control lever and the load states of the actuators, and therefore, the following problems occur, for example.

When an operator operates the control lever at high speed, the delivery flow rate of the hydraulic pump connected to the actuator as an operation target increases rapidly, and torque (demanded torque) demanded from the engine by the hydraulic pump according to the load pressure on the actuator rises sharply. At this time, engine output power torque may not rise in time with respect to the rise in the demanded torque, and a phenomenon (lug-down) in which engine speed is stopped or temporarily decreased may occur even when the absolute value of the demanded torque is less than a maximum rated torque of the engine. In the hydraulic closed circuit that directly drives the actuator by the hydraulic pump, in particular, this tendency becomes noticeable because restrictor elements do not intervene between the actuator and the hydraulic pump and a load on the actuator is directly transmitted to the hydraulic pump.

The present invention has been made in view of the above-described problems. It is an object of the present invention to provide a construction machine that can suppress lugging down of an engine irrespective of contents of operation of an operator and the load states of actuators.

Means for Solving the Problems

In order to achieve the above object, according to the present invention, there is provided a construction machine including: an engine; a variable displacement first hydraulic pump driven by the engine; a first hydraulic actuator driven by pressure liquid delivered from the first hydraulic pump; a operation device configured to give instructions for an operation direction and a demanded velocity of the first hydraulic actuator; and a controller configured to control a delivery flow rate of the first hydraulic pump according to an input from the operation device; wherein the construction machine comprises a pressure sensor configured to detect a load pressure on the first hydraulic actuator, and the controller includes: a demanded torque estimating section configured to estimate demanded torque as torque demanded from the engine by the first hydraulic pump on a basis of the demanded velocity of the first hydraulic actuator and the load pressure on the first hydraulic actuator; a demanded velocity limiting section configured to, in a case in which a demanded torque change rate as a change rate of the demanded torque exceeds a predetermined change rate, limit the demanded velocity such that the demanded torque change rate becomes equal to or lower than the predetermined change rate; and a command calculating section configured to calculate the delivery flow rate of the first hydraulic pump on a basis of the demanded velocity of the first hydraulic actuator, the demanded velocity being limited by the demanded velocity limiting section.

According to the present invention configured as described above, the demanded torque for the engine is estimated on the basis of the demanded velocity of the first hydraulic actuator and the load pressure on the first hydraulic actuator, and in a case in which the demanded torque change rate exceeds the predetermined change rate, the demanded velocity of the first hydraulic actuator is limited such that the demanded torque change rate becomes equal to or lower than the predetermined change rate. It is thereby possible to suppress lugging down of the engine irrespective of contents of operation of the operator and the load state of the hydraulic actuator.

Advantages of the Invention

According to the present invention, a construction machine including a hydraulic drive system that supplies pressure liquid to a hydraulic actuator by a hydraulic pump driven by an engine can suppress lugging down of the engine irrespective of contents of operation of an operator and the load state of the actuator.

MODES FOR CARRYING OUT THE INVENTION

Figure 1:
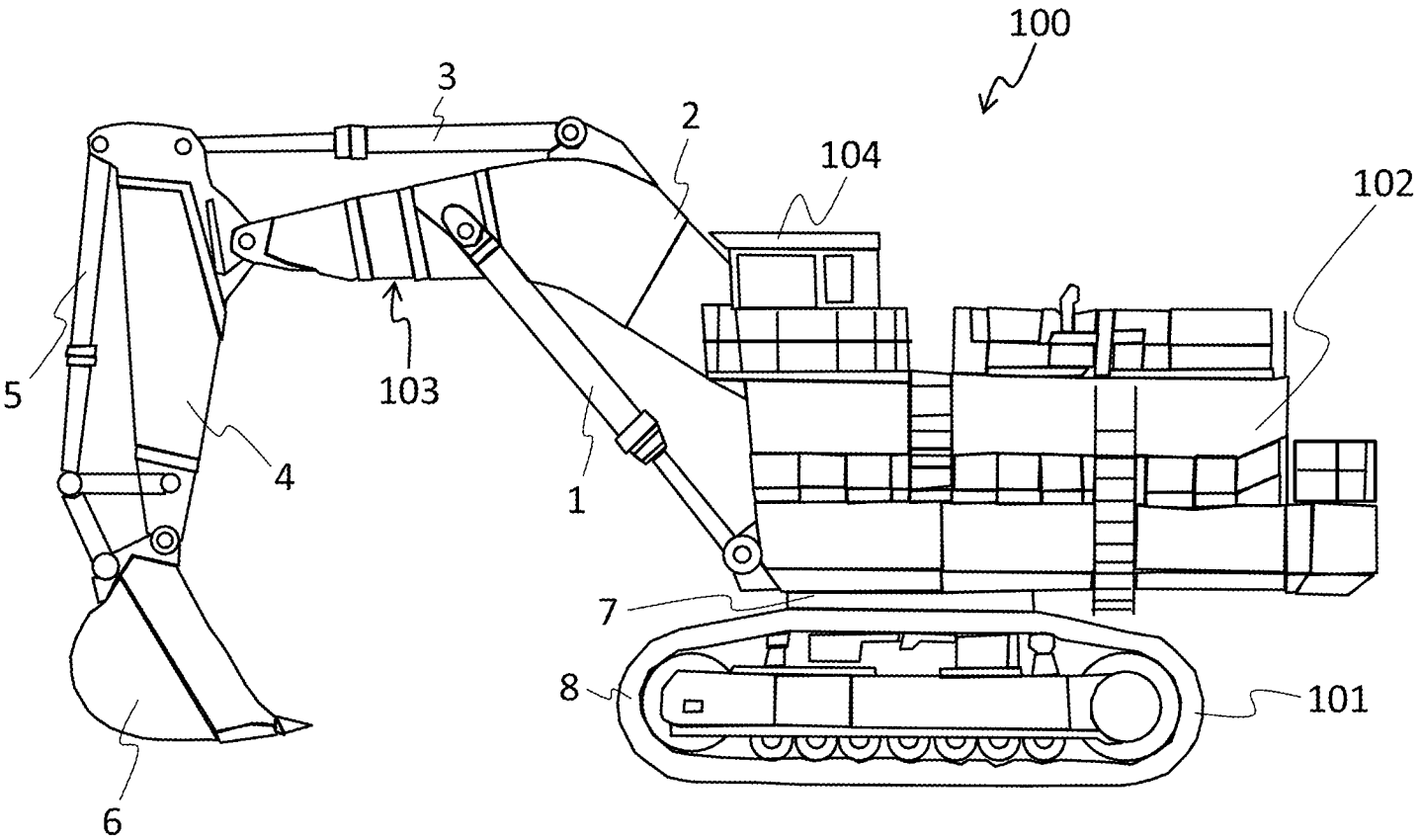
FIG. 1 is a side view of a hydraulic excavator as an example of a construction machine according to a first embodiment of the present invention.

A hydraulic excavator will hereinafter be cited as an example of a construction machine according to an embodiment of the present invention and described with reference to the drawings. Incidentally, in each figure, equivalent members are identified by the same reference numerals, and repeated description thereof will be omitted as appropriate.

First Embodiment

FIG. 1 is a side view of a hydraulic excavator according to a first embodiment of the present invention.

In FIG. 1, a hydraulic excavator 100 includes: a lower track structure 101 equipped with a crawler type track device 8; an upper swing structure 102 swingably attached onto the lower track structure 101 via a swing motor 7; and a front work device 103 attached to a front portion of the upper swing structure 102 so as to be rotatable in an upward-downward direction. A cab 104 that an operator boards is provided on the upper swing structure 102.

The front work device 103 includes: a boom 2 attached to the front portion of the upper swing structure 102 so as to be rotatable in the upward-downward direction; an arm 4 as a work member coupled to a front end portion of the boom 2 so as to be rotatable in the upward-downward direction or a forward-rearward direction; a bucket 6 as a work member coupled to a front end portion of the arm 4 so as to be rotatable in the upward-downward direction or the forward-rearward direction; a hydraulic pressure cylinder (hereinafter, a boom cylinder) 1 that drives the boom 2; a hydraulic pressure cylinder (hereinafter, an arm cylinder) 3 that drives the arm 4; and a hydraulic pressure cylinder (hereinafter, a bucket cylinder) 5 that drives the bucket 6.

Figure 2:
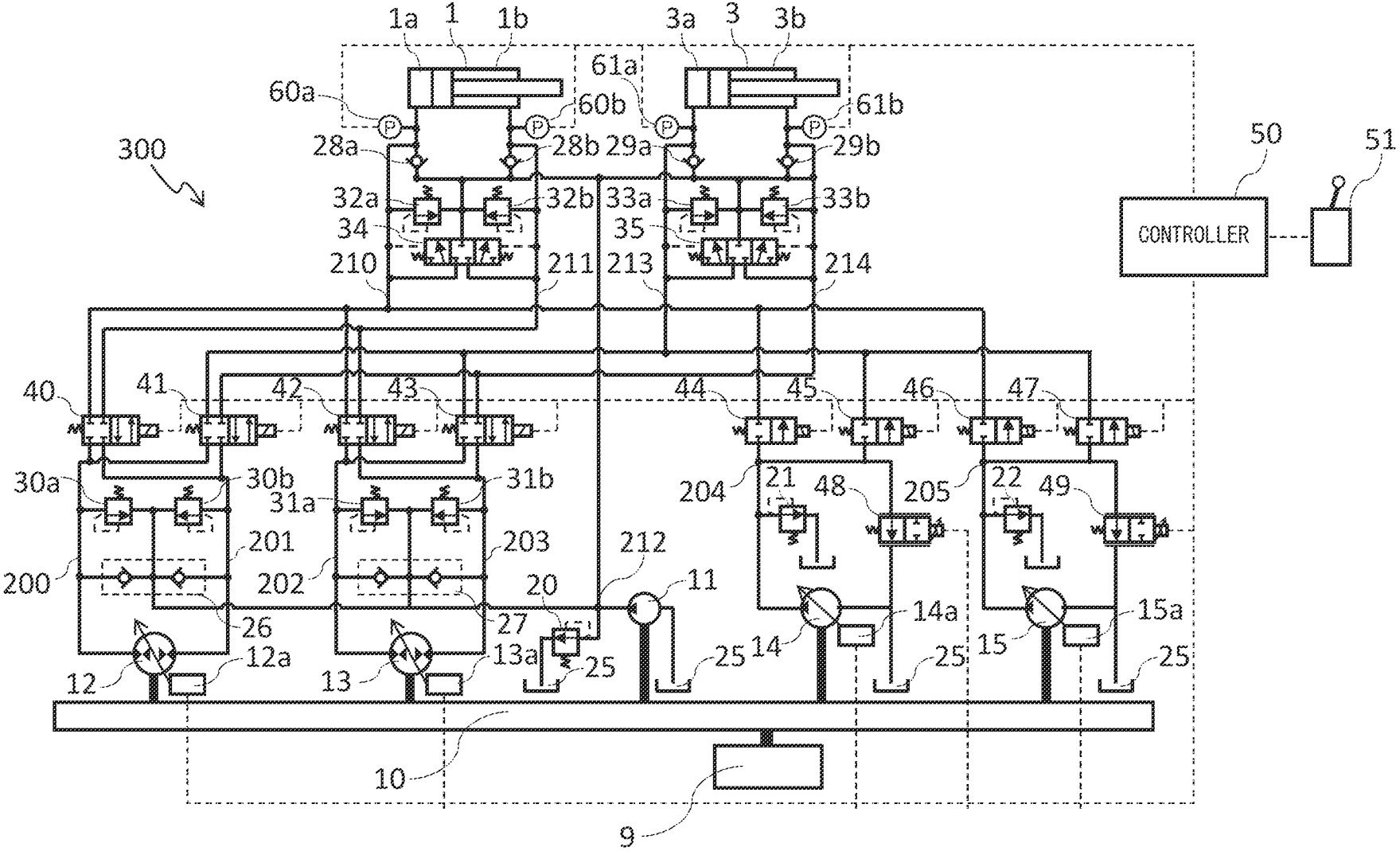
FIG. 2 is a schematic configuration diagram of a hydraulic drive system included in the hydraulic excavator shown in FIG. 1.

FIG. 2 is a schematic configuration diagram of a hydraulic drive system included in the hydraulic excavator 100 shown in FIG. 1. Incidentally, for simplification of description, FIG. 2 shows only parts related to the driving of the boom cylinder 1 and the arm cylinder 3 and does not show parts related to the driving of other actuators.

In FIG. 2, the hydraulic drive system 300 includes: the boom cylinder 1; the arm cylinder 3; a lever 51 as an operation device that gives instructions for the respective operation directions and the respective demanded velocities of the boom cylinder 1 and the arm cylinder 3; an engine 9 as a power source; a power transmission device 10 that distributes the power of the engine 9; a first to a fourth hydraulic pumps 12 to 15 and a charge pump 11 driven by the power distributed by the power transmission device 10; selector valves 40 to 47 capable of changing connection between the first to the fourth hydraulic pumps 12 to 15 and hydraulic actuators 1 and 3; proportional valves 48 and 49; and a controller 50 that controls the selector valves 40 to 47, the proportional valves 48 and 49, and regulators 12*a*, 13*a*, 14*a*, and 15*a* to be described later.

The engine 9 as a power source is connected to the power transmission device 10 that distributes the power. The power transmission device 10 is connected with the first to the fourth hydraulic pumps 12 to 15 and the charge pump 11.

The first to the fourth hydraulic pumps 12 to 15 each include a tilting swash plate mechanism having a pair of input and output ports and include regulators 12*a*, 13*a*, 14*a*, and 15*a* that adjust a tilting angle of a tilting swash plate, respectively.

The regulators 11*a*, 12*a*, 13*a*, and 14*a* adjust the respective tilting angles of the tilting swash plates of the first to the fourth hydraulic pumps 12 to 15 according to signals from the controller 50.

The first and the second hydraulic pumps 12 and 13 can control the delivery flow rates and directions of hydraulic operating fluid from the input and output ports by adjusting the tilting angles of the tilting swash plates.

The charge pump 11 supplies a flow passage 212 with hydraulic fluid.

The first and the second hydraulic pumps 12 and 13 function also as a hydraulic motor when supplied with the hydraulic fluid.

Flow passages 200 and 201 are connected to the pair of input and output ports of the first hydraulic pump 12. The selector valves 40 and 41 are connected to the flow passages 200 and 201. The selector valves 40 and 41 switch between communication and interruption of the flow passages according to signals from the controller 50. The selector valves 40 and 41 are in an interrupting state when there are no signals from the controller 50 to the selector valves 40 and 41.

The selector valve 40 is connected to the boom cylinder 1 via each of flow passages 210 and 211. When the selector valve 40 is set in a communicating state according to a signal from the controller 50, the first hydraulic pump 12 forms a closed circuit by being connected to the boom cylinder 1 via the flow passages 200 and 201, the selector valve 40, and the flow passages 210 and 211.

The selector valve 41 is connected to the arm cylinder 3 via each of flow passages 213 and 214. When the selector valve 41 is set in a communicating state according to a signal from the controller 50, the first hydraulic pump 12 forms a closed circuit by being connected to the arm cylinder 3 via the flow passages 200 and 201, the selector valve 41, and the flow passages 213 and 214.

Flow passages 202 and 203 are connected to the pair of input and output ports of the second hydraulic pump 13. Selector valves 42 and 43 are connected to the flow passages 202 and 203. The selector valves 42 and 43 switch between communication and interruption of the flow passages according to signals from the controller 50. The selector valves 42 and 43 are in an interrupting state when there are no signals from the controller 50 to the selector valves 42 and 43.

The selector valve 42 is connected to the boom cylinder 1 via each of the flow passages 210 and 211. When the selector valve 42 is set in a communicating state according to a signal from the controller 50, the second hydraulic pump 13 forms a closed circuit by being connected to the boom cylinder 1 via the flow passages 202 and 203, the selector valve 42, and the flow passages 210 and 211.

The selector valve 43 is connected to the arm cylinder 3 via each of the flow passages 213 and 214. When the selector valve 43 is set in a communicating state according to a signal from the controller 50, the second hydraulic pump 13 forms a closed circuit by being connected to the arm cylinder 3 via the flow passages 202 and 203, the selector valve 43, and the flow passages 213 and 214.

One side of the pair of input and output ports of the third hydraulic pump 14 is connected to selector valves 44 and 45, the proportional valve 48, and a relief valve 21 via a flow passage 204. An opposite side of the pair of input and output ports of the third hydraulic pump 14 is connected to a tank 25.

The relief valve 21 lets the hydraulic operating fluid escape to the tank 25 and thereby protects the circuit when flow passage pressure becomes equal to or higher than a predetermined pressure.

The selector valves 44 and 45 switch between communication and interruption of the flow passages according to signals from the controller 50. The selector valves 44 and 45 are in an interrupting state when there are no signals from the controller 50 to the selector valves 44 and 45.

The selector valve 44 is connected to the boom cylinder 1 via the flow passage 210.

The selector valve 45 is connected to the arm cylinder 3 via the flow passage 213.

The proportional valve 48 changes an opening area and thereby controls a passing flow rate according to a signal from the controller 50. When there is no signal from the controller 50 to the proportional valve 48, the proportional valve 48 is maintained at a maximum opening area. In addition, when the selector valves 44 and 45 are in an interrupting state, the controller 50 gives a signal to the proportional valve 48 so as to have an opening area determined in advance according to the delivery flow rate of the third hydraulic pump 14.

One side of the pair of input and output ports of the fourth hydraulic pump 15 is connected to the selector valves 46 and 47, the proportional valve 49, and a relief valve 22 via a flow passage 205. An opposite side of the pair of input and output ports of the fourth hydraulic pump 15 is connected to the tank 25.

The relief valve 22 lets the hydraulic operating fluid escape to the tank 25 and thereby protects the circuit when flow passage pressure becomes equal to or higher than a predetermined pressure.

The selector valves 46 and 47 switch between communication and interruption of the flow passages according to signals from the controller 50. The selector valves 46 and 47 are in an interrupting state when there are no signals from the controller 50 to the selector valves 46 and 47.

The selector valve 46 is connected to the boom cylinder 1 via the flow passage 210.

The selector valve 47 is connected to the arm cylinder 3 via the flow passage 213.

The proportional valve 49 changes an opening area and thereby controls a passing flow rate according to a signal from the controller 50. When there is no signal from the controller 50 to the proportional valve 49, the proportional valve 49 is maintained at a maximum opening area. In addition, when the selector valves 46 and 47 are in an interrupting state, the controller 50 gives a signal to the proportional valve 49 so as to have an opening area determined in advance according to the delivery flow rate of the fourth hydraulic pump 15.

A delivery port of the charge pump 11 is connected to a charge relief valve 20 and charge check valves 26, 27, 28*a*, 28*b*, 29*a*, and 29*b* via the flow passage 212.

A suction port of the charge pump 11 is connected to the tank 25.

The charge relief valve 20 adjusts the charge pressure of each of the charge check valves 26, 27, 28*a*, 28*b*, 29*a*, and 29*b*.

The charge check valve 26 supplies the hydraulic fluid of the charge pump 11 to each of the flow passages 200 and 201 when the pressure of each of the flow passages 200 and 201 falls below a pressure set by the charge relief valve 20.

The charge check valve 27 supplies the hydraulic fluid of the charge pump 11 to each of the flow passages 202 and 203 when the pressure of each of the flow passages 202 and 203 falls below the pressure set by the charge relief valve 20.

The charge check valves 28*a* and 28*b* supply the hydraulic fluid of the charge pump 11 to each of the flow passages 210 and 211 when the pressure of each of the flow passages 210 and 211 falls below the pressure set by the charge relief valve 20.

The charge check valves 29*a* and 29*b* supply the hydraulic fluid of the charge pump 11 to each of the flow passages 213 and 214 when the pressure of each of the flow passages 213 and 214 falls below the pressure set by the charge relief valve 20.

Relief valves 30*a* and 30*b* respectively provided to the flow passages 200 and 201 let the hydraulic operating fluid escape to the tank 25 via the charge relief valve 20 and thereby protect the circuit when flow passage pressure becomes equal to or higher than a predetermined pressure.

Relief valves 31*a* and 31*b* respectively provided to the flow passages 202 and 203 let the hydraulic operating fluid escape to the tank 25 via the charge relief valve 20 and thereby protect the circuit when flow passage pressure becomes equal to or higher than a predetermined pressure.

The flow passage 210 is connected to a head chamber 1*a* of the boom cylinder 1.

The flow passage 211 is connected to a rod chamber 1*b* of the boom cylinder 1.

The boom cylinder 1 is a hydraulic single rod cylinder that performs expanding and contracting operations by receiving the supply of the hydraulic operating fluid. The expanding or contracting direction of the boom cylinder 1 depends on the supply direction of the hydraulic operating fluid.

Relief valves 32*a* and 32*b* respectively provided to the flow passages 210 and 211 let the hydraulic operating fluid escape to the tank 25 via the charge relief valve 20 and thereby protect the circuit when flow passage pressure becomes equal to or higher than a predetermined pressure.

A flushing valve 34 provided to the flow passages 210 and 211 discharges excess oil within the flow passages to the tank 25 via the charge relief valve 20.

The flow passage 213 is connected to a head chamber 3*a* of the arm cylinder 3.

The flow passage 214 is connected to a rod chamber 3*b* of the arm cylinder 3.

The arm cylinder 3 is a hydraulic single rod cylinder that performs expanding and contracting operations by receiving the supply of the hydraulic operating fluid. The expanding or contracting direction of the arm cylinder 3 depends on the supply direction of the hydraulic operating fluid.

Relief valves 33*a* and 33*b* respectively provided to the flow passages 213 and 214 let the hydraulic operating fluid escape to the tank 25 via the charge relief valve 20 and thereby protect the circuit when flow passage pressure becomes equal to or higher than a predetermined pressure.

A flushing valve 35 provided to the flow passages 210 and 211 discharges excess oil within the flow passages to the tank 25 via the charge relief valve 20.

A pressure sensor 60*a* connected to the flow passage 210 measures the pressure of the flow passage 210 and inputs the pressure of the flow passage 210 to the controller 50. The pressure sensor 60*a* measures the head chamber pressure of the boom cylinder 1 by measuring the pressure of the flow passage 210.

A pressure sensor 60*b* connected to the flow passage 211 measures the pressure of the flow passage 211 and inputs the pressure of the flow passage 211 to the controller 50. The pressure sensor 60*b* measures the rod chamber pressure of the boom cylinder 1 by measuring the pressure of the flow passage 211.

A pressure sensor 61*a* connected to the flow passage 213 measures the pressure of the flow passage 213 and inputs the pressure of the flow passage 213 to the controller 50. The pressure sensor 61*a* measures the head chamber pressure of the arm cylinder 3 by measuring the pressure of the flow passage 213.

A pressure sensor 61*b* connected to the flow passage 214 measures the pressure of the flow passage 214 and inputs the pressure of the flow passage 214 to the controller 50. The pressure sensor 61*b* measures the rod chamber pressure of the arm cylinder 3 by measuring the pressure of the flow passage 214.

The lever 51 inputs an amount of operation on each actuator from the operator to the controller 50.

Figure 3:
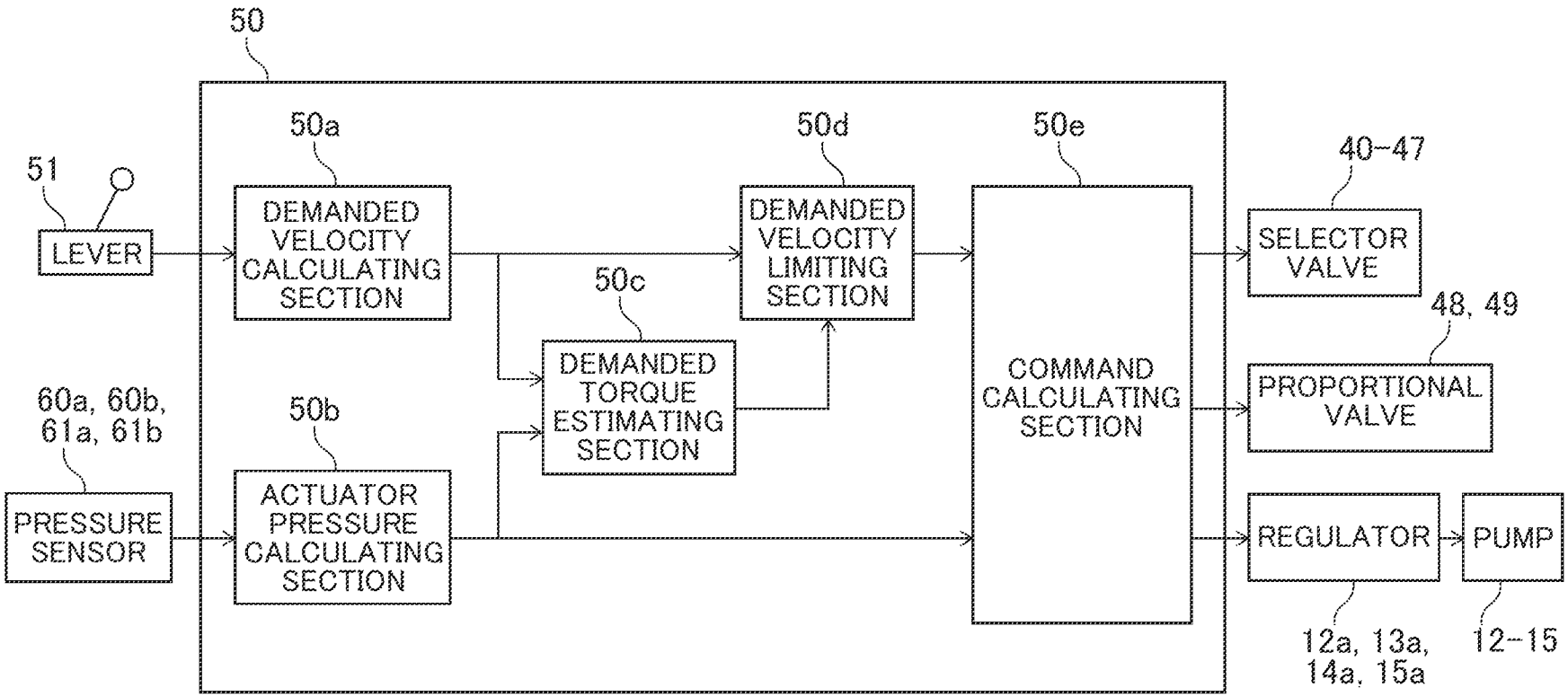
FIG. 3 is a functional block diagram of a controller shown in FIG. 2.

FIG. 3 is a functional block diagram of the controller 50 shown in FIG. 2. Incidentally, as with FIG. 2, FIG. 3 shows only parts related to the driving of the boom cylinder 1 and the arm cylinder 3 and does not show parts related to the driving of the other actuators.

In FIG. 3, the controller 50 includes a demanded velocity calculating section 50*a*, an actuator pressure calculating section 50*b*, a demanded torque estimating section 50*c*, a demanded velocity limiting section 50*d*, and a command calculating section 50*e*.

The demanded velocity calculating section 50*a* calculates the operation direction and demanded velocity of each actuator in response to a lever input of the operator, and outputs the operation direction and demanded velocity of each actuator to the demanded torque estimating section 50*c* and the demanded velocity limiting section 50*d*.

The actuator pressure calculating section 50*b* calculates the pressures of the actuators 1 and 3 (which pressures will hereinafter be actuator pressures) from the values of the pressure sensors 60*a*, 60*b*, 61*a*, and 61*b* provided to the respective parts, and outputs the actuator pressures to the demanded torque estimating section 50*c* and the command calculating section 50*e*.

The demanded torque estimating section 50*c* estimates torque imposed on the engine 9 (which torque will hereinafter be demanded torque) when the actuators 1 and 3 are driven according to the lever input of the operator on the basis of the demanded velocity input from the demanded velocity calculating section 50*a* and the actuator pressures input from the actuator pressure calculating section 50*b*.

The demanded velocity limiting section 50*d* computes a change rate of the demanded torque (which change rate will hereinafter be a demanded torque change rate) on the basis of the demanded torque input from the demanded torque estimating section 50*c*. Then, the demanded velocity limiting section 50*d* limits the demanded velocity input from the demanded velocity calculating section 50*a* such that the demanded torque change rate does not exceed an allowable torque change rate (to be described later) preset on the basis of characteristics of the engine 9, and outputs the limited demanded velocity to the command calculating section 50*e*.

The command calculating section 50*e* calculates command values to the selector valves 40 to 47, the proportional valves 48 and 49, and the regulators 12*a*, 13*a*, 14*a*, and 15*a* on the basis of the actuator pressures input from the actuator pressure calculating section 50*b* and the demanded velocity input from the demanded velocity limiting section 50*d*.

Operation of the hydraulic drive system 300 shown in FIG. 2 will next be described.

(1) During Non-Operation

In FIG. 2, when the lever 51 is not operated, the first to the fourth hydraulic pumps 12 to 15 are all controlled to a minimum tilting angle, the selector valves 40 to 47 are all closed, and the boom cylinder 1 and the arm cylinder 3 are maintained in a stop state.

(2) During Boom Raising Operation

Figure 4:
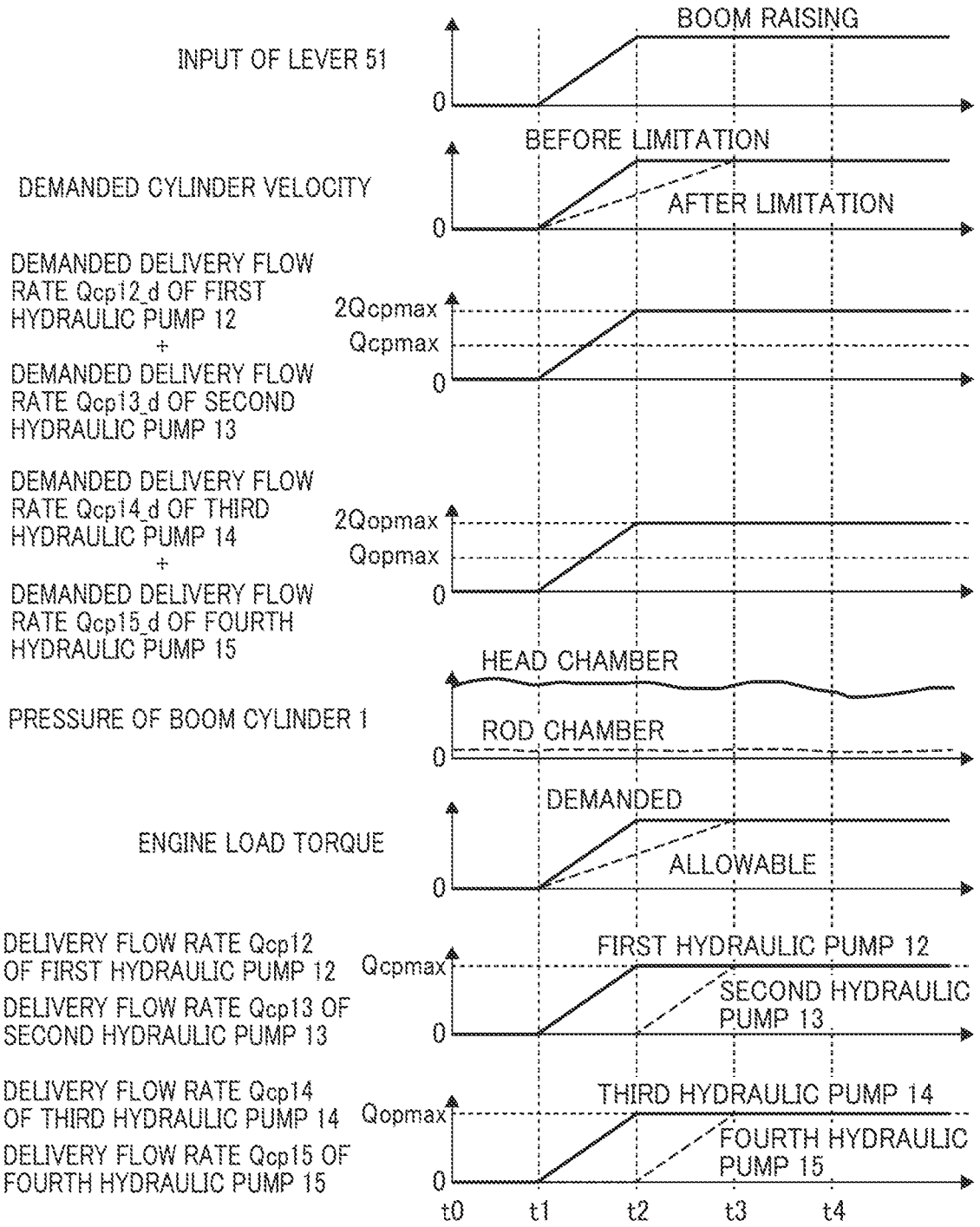
FIG. 4 is a diagram showing behavior during boom raising operation of the hydraulic drive system shown in FIG. 2.

FIG. 4 shows changes in input of the lever 51, demanded cylinder velocity based on the input of the lever 51, a sum of the demanded delivery flow rate of the first hydraulic pump 12 and the demanded delivery flow rate of the second hydraulic pump 13, a sum of the demanded delivery flow rate of the third hydraulic pump 14 and the demanded delivery flow rate of the fourth hydraulic pump 15, the head chamber pressure and the rod chamber pressure of the boom cylinder 1 which are respectively measured by the pressure sensors 60*a* and 60*b*, engine load torque, the delivery flow rate of the first hydraulic pump 12, the delivery flow rate of the second hydraulic pump 13, the delivery flow rate of the third hydraulic pump 14, and the delivery flow rate of the fourth hydraulic pump 15 in a case where the hydraulic drive system 300 performs an expanding operation of the boom cylinder 1.

Over a period from time t0 to time t1, the input of the lever 51 is zero, and the boom cylinder 1 is stationary.

Over a period from time t1 to time t2, a command value for expanding the boom cylinder 1 as the input of the lever 51 is increased to a maximum value.

Figure 5:
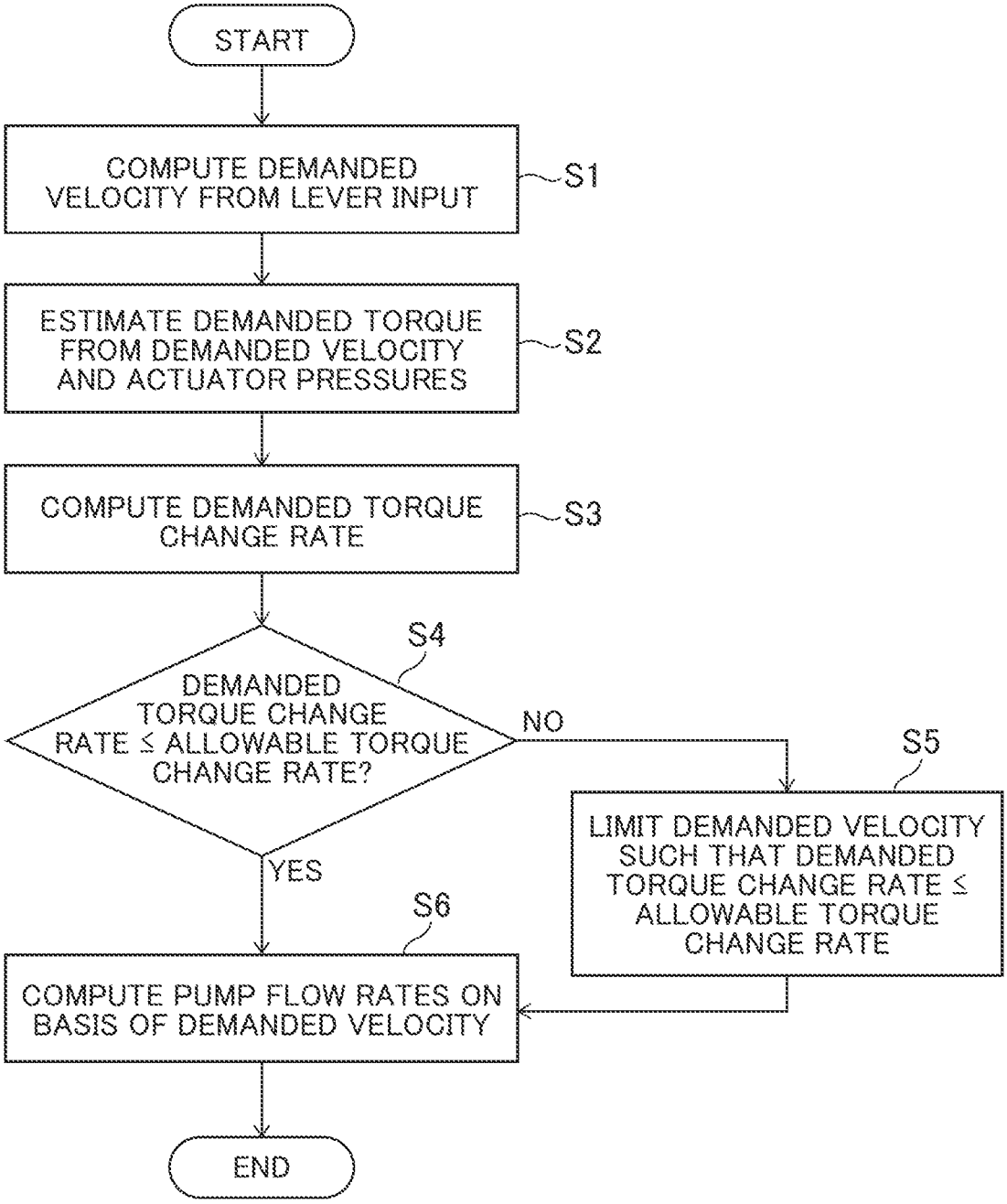
FIG. 5 is a flowchart showing processing of the controller shown in FIG. 2.

FIG. 5 is a flowchart showing a flow of pump load torque control of the controller 50.

First, in step S1, the controller 50 determines a demanded cylinder velocity Vcyl_d from an input value Lin of the lever 51.

[Equation 1]

$$V_{cyl_d}=f(L_{in}) \tag{1}$$

Next, in step S2, the controller 50 computes a sum Qcp_d of the demanded delivery flow rate of the first hydraulic pump 12 and the demanded delivery flow rate of the second hydraulic pump 13 and a sum Qop_d of the demanded delivery flow rate of the third hydraulic pump 14 and the demanded delivery flow rate of the fourth hydraulic pump 15 from the demanded cylinder velocity Vcyl_d as follows, for example.

When the cylinder is expanded at the demanded cylinder velocity Vcyl_d, a flow rate Qcyl_r of a flow out of the rod satisfies the following equation:

[Equation 2]

$$Q_{cyl_r}=V_{cyl_d}\times A_{cyl_r} \tag{2}$$

where Acyl_r is the pressure receiving area of the rod chamber. A flow rate Qcyl_h of a flow into the head chamber satisfies the following equation:

[Equation 3]

$$Q_{cyl_h}=V_{cyl_d}\times A_{cyl_h} \tag{3}$$

where Acyl_h is the pressure receiving area of the head chamber.

The sum Qcp_d of the demanded delivery flow rate of the first hydraulic pump 12 and the demanded delivery flow rate of the second hydraulic pump 13, the first hydraulic pump 12 and the second hydraulic pump 13 being connected to the cylinder in a closed circuit manner, is equal to the flow rate of a flow out of the rod chamber of the cylinder. Therefore, the following equation is satisfied:

[Equation 4]

$$Q_{cp_d}=Q_{cyl_r} \tag{4}$$

In addition, when the rod chamber and the head chamber of the cylinder are connected in a closed circuit manner, in order to compensate for an amount of flow rate deficiency occurring due to a pressure receiving area difference, the sum Qop_d of the demanded delivery flow rate of the third hydraulic pump 14 and the demanded delivery flow rate of the fourth hydraulic pump 15 is expressed by the following equation:

[Equation 5]

$$Q_{op_d}=Q_{cyl_h}-Q_{cyl_r} \tag{5}$$

Here, a ratio between the pressure receiving area Acyl_r of the rod chamber and the pressure receiving area Acyl_h of the head chamber is set as

[Equation 6]

$$\alpha=\frac{A_{cyl_r}}{A_{cyl_h}} \tag{6}$$

Then, Equation (5) is expressed by the following equation:

[Equation 7]

$$Q_{op_d}=\left(\frac{1}{\alpha}-1\right)Q_{cp_d} \tag{7}$$

In the same step S2, the controller 50 computes demanded torque Tp_d generated by the first to the fourth hydraulic pumps 12 to 15 when the boom cylinder 1 is driven according to the input of the lever 51 as follows, for example, from a head chamber pressure Pcyl_h and a rod chamber pressure Pcyl_r of the boom cylinder 1, the head chamber pressure Pcyl_h and the rod chamber pressure Pcyl_r being respectively measured by the pressure sensors 60*a* and 60*b*, the sum Qcp_d of the demanded delivery flow rate of the first hydraulic pump 12 and the demanded delivery flow rate of the second hydraulic pump 13, and the sum Qop_d of the demanded delivery flow rate of the third hydraulic pump 14 and the demanded delivery flow rate of the fourth hydraulic pump 15.

First, a sum Tcp_d of the demanded torque of the first hydraulic pump 12 and the demanded torque of the second hydraulic pump 13 when the cylinder is expanded is expressed by the following equation:

[Equation 8]

$$T_{cp_d}=\frac{Q_{cp_d}}{N_{eng}}((P_{cyl_h}+P_{loss})-(P_{cyl_r}-P_{loss}))\times\eta_{cp} \tag{8}$$

where Neng is an engine speed, Ploss is a pressure loss occurring in lines from the cylinder to the pumps, and ηcp is pump efficiency of the first hydraulic pump 12 and the second hydraulic pump 13.

In addition, a sum Top_d of the demanded torque of the third hydraulic pump 14 and the demanded torque of the fourth hydraulic pump 15 when the cylinder is expanded is expressed by the following equation:

[Equation 9]

$$T_{op_d}=\frac{Q_{op_d}}{N_{eng}}(P_{cyl_h}+P_{loss})\times\eta_{op} \tag{9}$$

where ηop is pump efficiency of the third hydraulic pump 14 and the fourth hydraulic pump 15.

From the above, the demanded torque Tp_d generated by the hydraulic pumps 12 to 15 is expressed by the following equation:

[Equation 10]

$$T_{p_d}=T_{cd_d}+T_{op_d} \tag{10}$$

Next, a change rate of the demanded torque Tp_d (demanded torque change rate) is computed in step S3. The demanded torque change rate is, for example, obtained by dividing a value resulting from subtracting a torque currently outputted by the engine 9 from the demanded torque Tp_d by a control cycle of the controller 50.

Next, when the demanded torque change rate computed in step S3 is equal to or lower than the change rate of an allowable torque Tp_lim (which change rate will hereinafter be an allowable torque change rate) in step S4, the controller 50 proceeds to step S6. The controller 50 otherwise proceeds to step S5. The allowable torque Tp_lim is torque that can be outputted by the engine 9. The allowable torque Tp_lim can be computed from information such as a fuel injection amount of the engine 9, turbo pressure, and the like. Here, the allowable torque Tp_lim and the allowable torque change rate may be obtained as follows.

Figure 6:
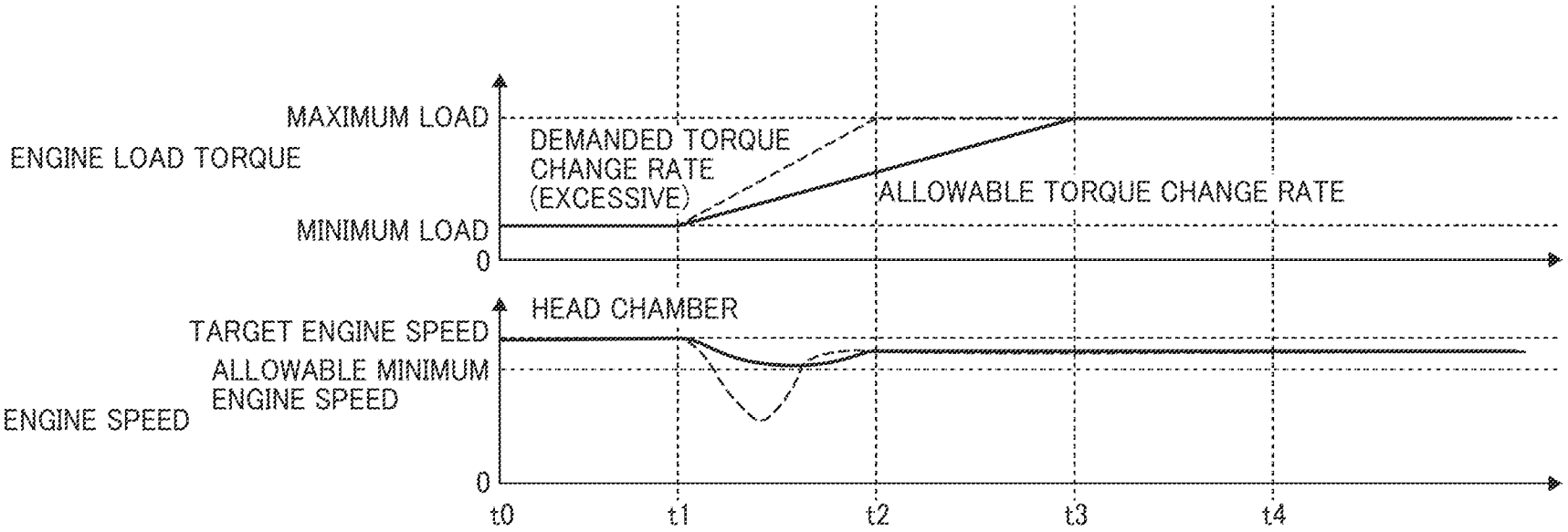
FIG. 6 is a diagram showing a relation between load torque and engine speed of an ordinary turbocharged engine.

In a case of a turbocharged engine, when a load is applied to the engine from a no-load state, a maximum design torque cannot be outputted until turbo pressure is raised. For example, as shown in FIG. 6, when the load on the engine is increased from a minimum value to a maximum value over a period from t1 to t2, engine output torque is not increased in time with respect to increase in the demanded torque, and the engine speed falls below an allowable minimum engine speed. In contrast, when the load is increased from the minimum value to the maximum value over a period from t1 to t3, the engine output torque is increased in time with respect to increase in the load torque, and therefore, the engine speed does not fall below the allowable minimum engine speed. Accordingly, suppose that a maximum torque change rate at which a decrease in the engine speed is suppressed to the allowable minimum engine speed is the allowable torque change rate, and that a maximum output torque satisfying the allowable torque change rate is the allowable torque Tp_lim. The allowable torque Tp_lim is, for example, obtained by adding a product of the allowable torque change rate and the control cycle of the controller 50 to the present engine output torque. That is, the allowable torque Tp_lim in the present invention changes momently according to the present engine output torque. Incidentally, while whether or not the demanded torque change rate is equal to or lower than the allowable torque change rate is determined in step S4, this determination is the same as determination of whether or not the demanded torque Tp_d is equal to or lower than the allowable torque Tp_lim.

In step S5, the controller 50 limits the demanded cylinder velocity Vcyl_d such that the demanded torque change rate is equal to or lower than the allowable torque change rate (that is, such that the demanded torque Tp_d is equal to or lower than the allowable torque Tp_lim). The limited demanded cylinder velocity Vcyl_d' can be obtained as follows, for example.

The engine 9 can output only up to the allowable torque Tp_lim with respect to the demanded torque Tp_d obtained in step S2. Thus, the sum Tcp_d of the demanded torque of the first hydraulic pump 12 and the demanded torque of the second hydraulic pump 13 and the sum Top_d of the demanded torque of the third hydraulic pump 14 and the demanded torque of the fourth hydraulic pump 15 need to be suppressed such that the following equation is satisfied.

[Equation 11]

$$T_{p_lim}=T_{cp_d}'+T_{op_d}' \tag{11}$$

From Equations (7), (8), and (9), the following equation is satisfied:

[Equation 12]

$$T_{p_lim}=Q_{cp_d}'\times G \tag{12}$$

Here,

[Equation 13]

$$G=\frac{1}{N_{eng}}(P_{cyl_h}-P_{cyl_r}+2P_{loss})\times\eta_{cp}+\left(\frac{1}{\alpha}-1\right)\frac{1}{N_{eng}}(P_{cyl_h}+P_{loss})\times\eta_{op} \tag{13}$$

Further, from Equation (2), the following equation is satisfied:

[Equation 14]

$$T_{p_lim}=V_{cyl_d}'\times A_{cyl_r}\times G \tag{14}$$

Hence, a limited cylinder velocity Vcyl_d' can be obtained as the following equation:

[Equation 15]

$$V_{cyl_d}'=\frac{T_{p_lim}}{A_{cyl_r}\times G} \tag{15}$$

In step S6, the controller 50 computes a demanded delivery flow rate Qcp1_*d* of the first hydraulic pump 12, a demanded delivery flow rate Qcp2_*d* of the second hydraulic pump 13, a demanded delivery flow rate Qop1_*d* of the third hydraulic pump 14, and a demanded delivery flow rate Qop2_*d* of the fourth hydraulic pump 15 on the basis of the demanded cylinder velocity Vcyl_d.

According to the processing flow shown in FIG. 5, when a command value for expanding the boom cylinder 1 as the input of the lever 51 is increased to a maximum value over a period from time t1 to time t2 shown in FIG. 4, the controller 50 computes the demanded cylinder velocity Vcyl_d from the input of the lever 51. Next, from the demanded cylinder velocity Vcyl_d, the controller 50 computes the sum Qcp_d of the demanded delivery flow rate of the first hydraulic pump 12 and the demanded delivery flow rate of the second hydraulic pump 13 by using Equations (2) and (4), and computes the sum Qop_d of the demanded delivery flow rate of the third hydraulic pump 14 and the demanded delivery flow rate of the fourth hydraulic pump 15 by using Equations (3) and (5). The controller 50 computes the demanded torque Tp_d by using Equations (8), (9), and (10) from the computed demanded delivery flow rates and the head chamber pressure and the rod chamber pressure of the boom cylinder 1, the head chamber pressure and the rod chamber pressure being measured by the pressure sensors 60*a* and 60*b*, respectively.

Supposing that, as shown in FIG. 4, the allowable torque Tp_lim of the engine 9 takes a period of time t1 to time t3 to become a maximum rated torque of the engine 9 whereas the demanded torque Tp_d increases to the maximum value over a period from time t1 to time t2, the controller 50 computes the limited cylinder velocity Vcyl_d' by using Equation (15) such that the demanded torque Tp_d is equal to or lower than the allowable torque Tp_lim of the engine 9 over a period from time t1 to time t3.

The controller 50 computes a delivery flow rate Qcp12 of the first hydraulic pump 12, a delivery flow rate Qcp13 of the second hydraulic pump 13, a demanded delivery flow rate Qop14 of the third hydraulic pump 14, and a demanded delivery flow rate Qop15 of the fourth hydraulic pump 15 on the basis of the limited cylinder velocity Vcyl_d'.

By performing control as described above, it is possible to operate the hydraulic excavator 100 without lugging down the engine 9.

Incidentally, in a case where horsepower is computed on the basis of the actuator pressures, variations in the actuator pressures may be suppressed by filter processing such as a moving average while the engine speed is stable and the pressure variations are equal to or less than a specified value, for example, in order to prevent the pump tilting angles from becoming vibrational due to the variations in the actuator pressures. In addition, while the pumps are started up one by one in the present embodiment, the pumps may be started up simultaneously.

(3) During Boom Lowering and Arm Dumping Operation

Figure 7:
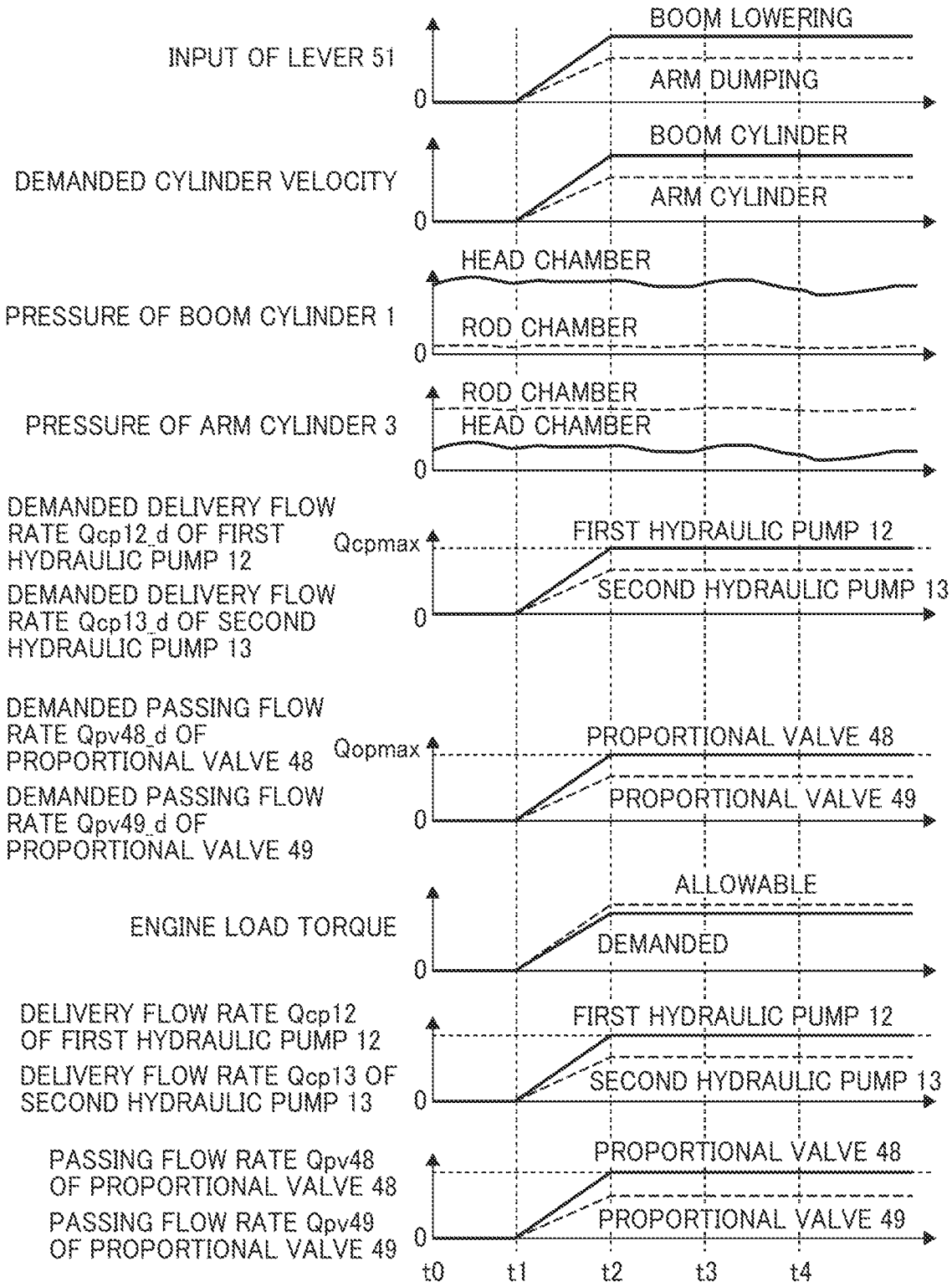
FIG. 7 is a diagram showing behavior during boom lowering and arm dumping operation of the hydraulic drive system shown in FIG. 2.

FIG. 7 shows changes in input of the lever 51, demanded cylinder velocities based on the input of the lever 51, the head chamber pressure and the rod chamber pressure of the boom cylinder 1 which are respectively measured by the pressure sensors 60*a* and 60*b*, the head chamber pressure and the rod chamber pressure of the arm cylinder 3 which are respectively measured by the pressure sensors 61*a* and 61*b*, the respective demanded delivery flow rates of the first and second hydraulic pumps 12 and 13, the respective demanded passing flow rates of the proportional valves 48 and 49, the engine load torque, the respective delivery flow rates of the first and second hydraulic pumps 12 and 13, and the respective passing flow rates of the proportional valves 48 and 49 in a case where the hydraulic drive system 300 simultaneously performs a contracting operation of the boom cylinder 1 and a contracting operation of the arm cylinder 3.

Over a period from time t0 to time t1, the input of the lever 51 is zero, and the boom cylinder 1 and the arm cylinder 3 are stationary.

Over a period from time t1 to time t2, command values for contracting the boom cylinder 1 and the arm cylinder 3 as the input of the lever 51 are increased to a maximum value.

According to the processing flow shown in FIG. 5, when the command values for contracting the boom cylinder 1 and the arm cylinder 3 as the input of the lever 51 are increased to a maximum value over the period from time t1 to time t2 shown in FIG. 7, the controller 50 computes a demanded boom cylinder velocity Vcyl_boom_d and a demanded arm cylinder velocity Vcyl_arm_d from the input of the lever 51.

Here, the controller 50 assigns the first hydraulic pump 12 to drive the boom cylinder 1, and assigns the second hydraulic pump 13 to drive the arm cylinder 3.

The controller 50 computes a demanded delivery flow rate Qcp12_*d* of the first hydraulic pump 12 from the demanded boom cylinder velocity Vcyl_boom_d by using Equations (2) and (4). In addition, the controller 50 computes a demanded delivery flow rate Qcp13_*d* of the second hydraulic pump 13 from the demanded arm cylinder velocity Vcyl_arm_d by using Equations (2) and (4).

When the cylinders are contracted, the first and second proportional valves 48 and 49 discharge, to the tank 25, an excess flow rate occurring due to a difference between the flow rate Qcyl_h of a flow out of the head chamber and the flow rate Qcyl_r of a flow into the rod chamber. A demanded passing flow rate Qpv_d of the first and second proportional valves 48 and 49 is expressed by the following equation:

[Equation 16]

$$Q_{pv_d}=Q_{cyl_h}-Q_{cyl_r} \tag{16}$$

From Equation (6), the following equation is satisfied:

[Equation 17]

$$Q_{pv_d}=\left(\frac{1}{\alpha}-1\right)Q_{cp_d} \tag{17}$$

Here, the controller 50 assigns the proportional valve 48 to discharge the excess flow rate of the boom cylinder 1 and assigns the proportional valve 49 to discharge the excess flow rate of the arm cylinder 3.

The controller 50 computes a demanded passing flow rate Qpv48_*d* of the proportional valve 48 from the demanded boom cylinder velocity Vcyl_boom_d by using Equations (3) and (16). In addition, the controller 50 computes a demanded passing flow rate Qpv49_*d* of the proportional valve 49 from the demanded arm cylinder velocity Vcyl_arm_d by using Equations (3) and (16).

When the cylinders are contracted, the third hydraulic pump 14 and the fourth hydraulic pump 15 are not used, and therefore, the sum Top_d of the demanded torque of the third hydraulic pump 14 and the demanded torque of the fourth hydraulic pump 15 is zero.

The controller 50 computes the demanded torque Tp_d by using Equations (8) and (10) from the computed demanded flow rates, the head chamber pressure and the rod chamber pressure of the boom cylinder 1 which are respectively measured by the pressure sensors 60*a* and 60*b*, and the head chamber pressure and the rod chamber pressure of the arm cylinder 3 which are respectively measured by the pressure sensors 61*a* and 61*b*.

As shown in FIG. 7, in a case where the head chamber pressure of the boom cylinder 1 is higher than the rod chamber pressure, at a time of boom raising that expands the boom cylinder 1, the delivery pressure of the first hydraulic pump 12 is higher than suction pressure thereof, and therefore, the first hydraulic pump 12 operates as a pump. Conversely, at a time of boom lowering that contracts the boom cylinder 1, the suction pressure of the first hydraulic pump 12 is higher than the delivery pressure thereof, and therefore, the first hydraulic pump 12 operates as a motor.

As shown in FIG. 7, in a case where the rod chamber pressure of the arm cylinder 3 is higher than the head chamber pressure, at a time of arm dumping that contracts the arm cylinder 3, the delivery pressure of the second hydraulic pump 13 is higher than suction pressure thereof, and therefore the second hydraulic pump 13 operates as a pump. Conversely, at a time of boom lowering, the suction pressure of the second hydraulic pump 13 is higher than the delivery pressure thereof, and therefore, the second hydraulic pump 13 operates as a motor.

Hence, in a case where the input of the lever 51 is boom lowering and arm dumping, since the first hydraulic pump 12 operates as a motor and the second hydraulic pump 13 operates as a pump, the sum Tcp_d of the demanded torque of the first hydraulic pump 12 and the demanded torque of the second hydraulic pump 13 is lower than that at a time of boom single operation when the first hydraulic pump 12 and the second hydraulic pump 13 both operate as a pump.

As shown in FIG. 7, when the allowable torque Tp_lim of the engine 9 allows the demanded torque to be outputted from time t1 to time t2 while the demanded torque Tp_d is increased to a maximum value over a period from time t1 to time t2, output can be performed as the demanded velocity according to the processing flow shown in FIG. 5. The controller 50 computes a delivery flow rate Qcp1 of the first hydraulic pump 12, a delivery flow rate Qcp2 of the second hydraulic pump 13, a passing flow rate Qpv48 of the proportional valve 48, and a passing flow rate Qpv49 of the proportional valve 49 from the demanded boom cylinder velocity Vcyl_boom_d and the demanded arm cylinder velocity Vcyl_arm_d.

By performing control as described above, it is possible to operate the hydraulic excavator 100 without lugging down the engine 9.

As shown in Equation (15), when the limited cylinder velocity Vcyl_d' is computed on the basis of the actuator pressures, vibrations of the actuator pressures may be suppressed by filter processing such as a moving average while the engine speed is stable and the pressure variations are equal to or less than a specified value, for example, in order to prevent the cylinder velocity Vcyl_d' from becoming vibrational due to the vibrations of the actuator pressures.

(4) During Boom Raising and Arm Dumping Operation

Figure 8:
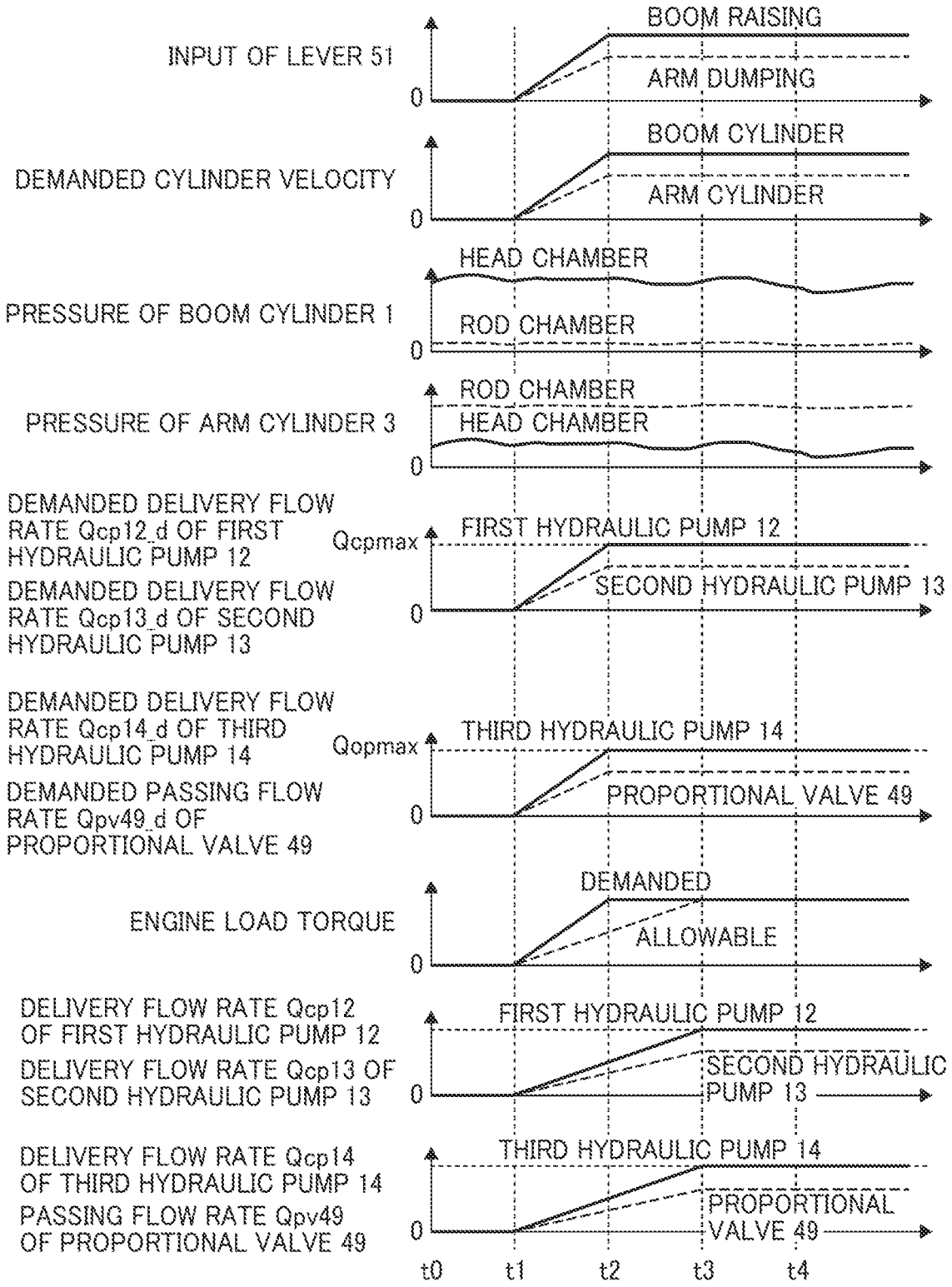
FIG. 8 is a diagram showing behavior during boom raising and arm dumping operation of the hydraulic drive system shown in FIG. 2.

FIG. 8 shows changes in input of the lever 51, demanded cylinder velocities based on the input of the lever 51, the head chamber pressure and the rod chamber pressure of the boom cylinder 1 which are respectively measured by the pressure sensors 60*a* and 60*b*, the head chamber pressure and the rod chamber pressure of the arm cylinder 3 which are respectively measured by the pressure sensors 61*a* and 61*b*, the respective demanded delivery flow rates of the first to the third hydraulic pumps 12 to 14, the demanded passing flow rate of the proportional valve 49, the engine load torque, the respective delivery flow rates of the first to the third hydraulic pumps 12 to 14, and the passing flow rate of the proportional valve 49 in a case where the hydraulic drive system 300 simultaneously performs an expanding operation of the boom cylinder 1 and a contracting operation of the arm cylinder 3.

Over a period from time t0 to time t1, the input of the lever 51 is zero, and the boom cylinder 1 and the arm cylinder 3 are stationary.

Over a period from time t1 to time t2, a command value for expanding the boom cylinder 1 and a command value for contracting the arm cylinder 3 as the input of the lever 51 are increased to a maximum value.

According to the processing flow shown in FIG. 5, when the command values for the boom cylinder 1 and for contracting the arm cylinder 3 as the input of the lever 51 are increased to a maximum value over a period from time t1 to time t2 shown in FIG. 8, the controller 50 computes the demanded boom cylinder velocity Vcyl_boom_d and the demanded arm cylinder velocity Vcyl_arm_d from the input of the lever 51.

Here, the controller 50 assigns the first hydraulic pump 12 and the third hydraulic pump 14 to drive the boom cylinder 1 and assigns the second hydraulic pump 13 and the proportional valve 49 to drive the arm cylinder 3.

The controller 50 computes a demanded delivery flow rate Qcp12_*d* of the first hydraulic pump 12 from the demanded boom cylinder velocity Vcyl_boom_d by using Equations (2) and (4). In addition, the controller 50 computes a demanded delivery flow rate Qcp13_*d* of the second hydraulic pump 13 from the demanded arm cylinder velocity Vcyl_arm_d by using Equations (2) and (4).

The sum Qop_d of the demanded delivery flow rate of the third hydraulic pump 14 and the demanded delivery flow rate of the fourth hydraulic pump 15 is computed by using Equations (3) and (5).

The controller 50 computes a demanded delivery flow rate Qop14_*d* of the third hydraulic pump 14 from the demanded boom cylinder velocity Vcyl_boom_d by using Equations (3) and (5).

The controller 50 computes a demanded passing flow rate Qpv49_*d* of the proportional valve 49 from the demanded arm cylinder velocity Vcyl_arm_d by using Equations (3) and (16).

The controller 50 computes a demanded torque Tcp12_*d* of the first hydraulic pump 12, a demanded torque Tcp13_*d* of the second hydraulic pump 13, and a demanded torque Top14_*d* of the third hydraulic pump 14 by using Equations (8) and (9) from the computed demanded flow rates, the head chamber pressure and the rod chamber pressure of the boom cylinder 1 which are respectively measured by the pressure sensors 60*a* and 60*b*, and the head chamber pressure and the rod chamber pressure of the arm cylinder 3 which are respectively measured by the pressure sensors 61*a* and 61*b*. At this time, the demanded torque Tp_d is expressed by the following equation:

[Equation 18]

$$T_{p_d}=T_{cp12_d}+T_{cp13_d}+T_{op14_d} \tag{18}$$

Supposing that, as shown in FIG. 8, the allowable torque Tp_lim of the engine 9 takes a period of time t1 to time t3 to become the maximum rated torque of the engine 9 whereas the demanded torque Tp_d increases to the maximum value over a period from time t1 to time t2, the controller 50 computes a limited boom cylinder velocity Vcyl_boom_d' and a limited arm cylinder velocity Vcyl_arm_d' over the period from time t1 to time t3 such that the following equation is satisfied:

[Equation 19]

$$T_{p_lim}=T_{cp12_d}'+T_{cp13_d}'+T_{op14_d}' \tag{19}$$

From Equations (2), (7), (8), and (9), the following equation is satisfied:

[Equation 20]

$$T_{p_lim}=V_{cyl_boom_d}'\times A_{cyl_boom_r}\times G+V_{cyl_arm_d}'\times A_{cyl_arm_r}\times H \tag{20}$$

Here,

[Equation 21]

$$H=\frac{1}{N_{eng}}(P_{cyl_h}-P_{cyl_r}+2P_{loss})\times\eta_{cp} \tag{21}$$

A ratio between the demanded boom cylinder velocity Vcyl_boom_d and the demanded arm cylinder velocity Vcyl_arm_d is set as

[Equation 22]

$$\beta=\frac{V_{cyl_boom_d}}{V_{cyl_arm_d}} \tag{22}$$

The limited boom cylinder velocity Vcyl_boom_d' and the limited arm cylinder velocity Vcyl_arm_d' are computed so as to hold this ratio constant. From Equations (20) and (22), the limited boom cylinder velocity Vcyl_boom_d' is expressed by the following equation:

[Equation 23]

$$V_{cyl_boom_d}' = \frac{T_{p_lim}}{A_{cyl_boom_r} \times G + \frac{A_{cyl_arm_r} \times H}{\beta}} \tag{23}$$

The limited arm cylinder velocity Vcyl_arm_d' is expressed by the following equation:

[Equation 24]

$$V_{cyl_arm_d}' = \frac{T_{p_lim}}{A_{cyl_boom_r} \times G \times \beta + A_{cyl_arm_r} \times H} \tag{24}$$

The controller 50 computes the delivery flow rate Qcp12 of the first hydraulic pump 12 and the demanded delivery flow rate Qop14 of the third hydraulic pump 14 on the basis of the limited boom cylinder velocity Vcyl_boom_d', and computes the delivery flow rate Qcp13 of the second hydraulic pump 13 and the passing flow rate Qpv49 of the proportional valve 49 on the basis of the limited arm cylinder velocity Vcyl_arm_d'.

By performing control as described above, it is possible to operate the hydraulic excavator 100 without lugging down the engine 9 while maintaining the demanded velocity ratio of each actuator which demanded velocity ratio is determined according to the input of the lever 51.

In the present embodiment, in the hydraulic excavator 100 including the engine 9, the variable displacement hydraulic pumps 12 to 15 driven by the engine 9, the hydraulic actuators 1 and 3 driven by pressure liquid delivered from the hydraulic pumps 12 to 15, the control valves 40 to 47 capable of changing connection between the hydraulic actuators 1 and 3 and the hydraulic pumps 12 to 15, the pressure sensors 60*a*, 60*b*, 61*a*, and 61*b* configured to detect the respective load pressures on the hydraulic actuators 1 and 3, the operation device 51 configured to give instructions for the respective operation directions and the respective demanded velocities of the hydraulic actuators 1 and 3, and the controller 50 configured to control the respective delivery flow rates of the hydraulic pumps 12 to 15 according to an input from the operation device 51, the controller 50 includes: the demanded torque estimating section 50*c* configured to estimate the demanded torque Tp_d as a sum of respective torques demanded from the engine 9 by the hydraulic pumps 12 to 15 on the basis of the respective demanded velocities and the respective load pressures on the hydraulic actuators 1 and 3; the demanded velocity limiting section 50*d* configured to, in a case in which the demanded torque change rate as the change rate of the demanded torque Tp_d exceeds a predetermined change rate (allowable torque change rate), limit the respective demanded velocities of the hydraulic actuators 1 and 3 such that the demanded torque change rate is equal to or lower than the predetermined change rate; and the command calculating section 50*e* configured to determine assignment of the hydraulic pumps 12 to 15 to the hydraulic actuators 1 and 3 and calculate the respective delivery flow rates of the hydraulic pumps 12 to 15 on the basis of the respective demanded velocities of the hydraulic actuators 1 and 3, the respective demanded velocities being limited by the demanded velocity limiting section 50*d*.

In addition, the hydraulic pumps 12 and 13 are each a double-delivery type hydraulic pump having a pair of input and output ports, and the control valves 40 to 43 are selector valves that can change connection between the hydraulic pumps 12 and 13 and the hydraulic actuators 1 and 3.

According to the present embodiment configured as described above, in the hydraulic excavator 100 including the hydraulic drive system 300 that controls flows of the hydraulic fluid supplied from the double-delivery type hydraulic pumps 12 and 13 to the actuators 1 and 3 by the selector valves 40 to 43, the demanded torque Tp_d for the engine 9 is estimated on the basis of the demanded velocities of the hydraulic actuators 1 and 3 and the load pressures on the hydraulic actuators 1 and 3, and in a case in which the demanded torque change rate exceeds the predetermined change rate (allowable torque change rate), the demanded velocities of the hydraulic actuators 1 and 3 are limited such that the demanded torque change rate is equal to or lower than the predetermined change rate. It is thereby possible to suppress lugging down of the engine 9 irrespective of contents of operation of the operator and the load states of the hydraulic actuators 1 and 3.

In addition, the command calculating section 50*e* is configured to reduce the number of hydraulic pumps assigned to one hydraulic actuator of the hydraulic actuators 1 and 3 according to the demanded velocity of the one hydraulic actuator, the demanded velocity being limited by the demanded velocity limiting section 50*d*, in a case in which the demanded torque change rate exceeds the predetermined change rate (allowable torque change rate) in a state in which two or more hydraulic pumps are assigned to the one hydraulic actuator. Thus, fuel consumption efficiency of hydraulic pumps being used is improved, and hydraulic pump assignment to a newly operated actuator is facilitated by increasing the number of unused hydraulic pumps.

Incidentally, while it is assumed in the present embodiment that the demanded cylinder velocity Vcyl_d is determined uniquely from the input of the lever 51 by Equation (1), the controller 50 may be provided with a computing function that changes the demanded cylinder velocity Vcyl_d according to the load state of each actuator and a balance of the input value of the lever 51.

Second Embodiment

A hydraulic excavator 100 according to a second embodiment of the present invention will be described centering on differences from the first embodiment.

Figure 9:
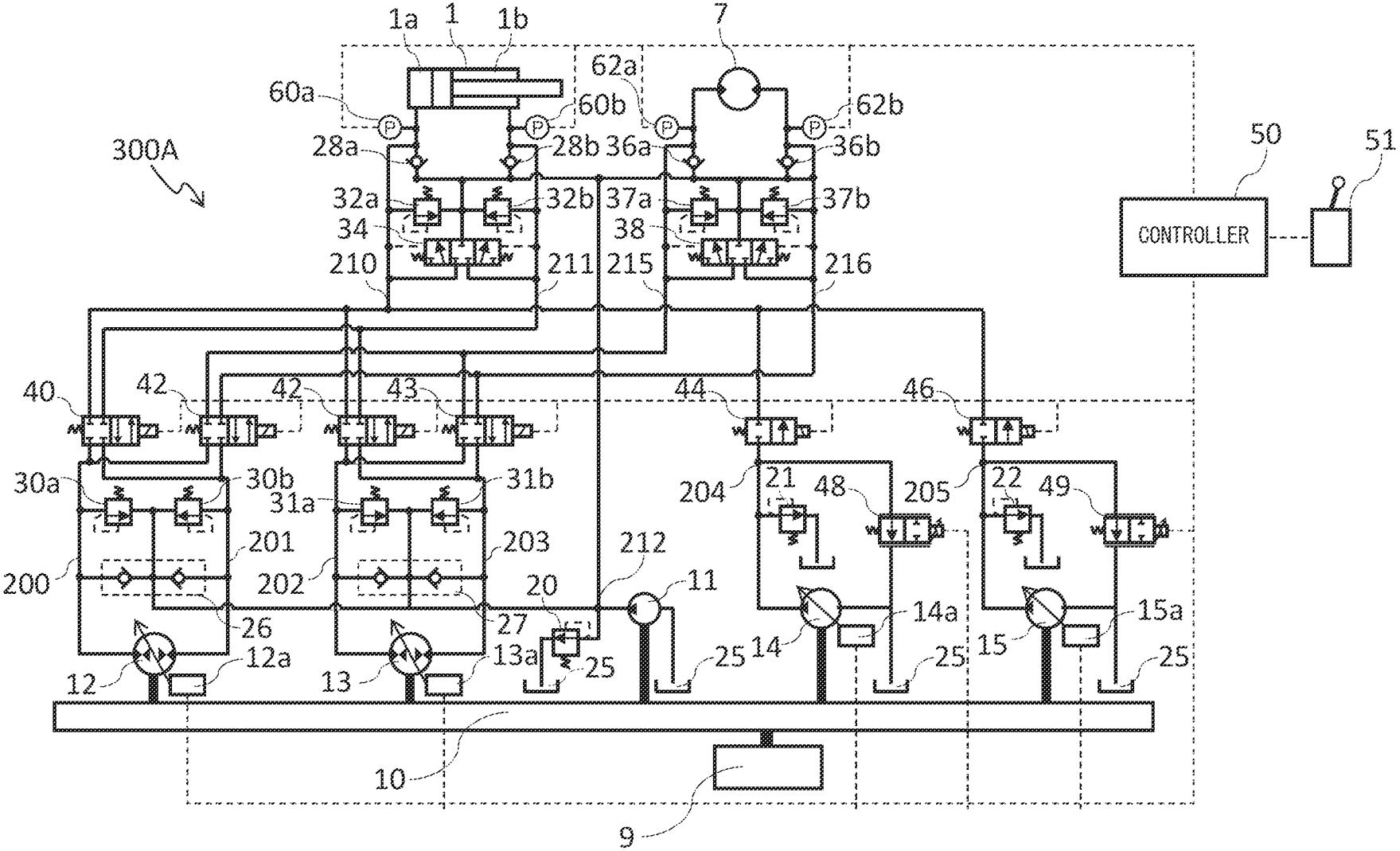
FIG. 9 is a schematic configuration diagram of a hydraulic drive system in a second embodiment of the present invention.

FIG. 9 is a schematic configuration diagram of a hydraulic drive system in the present embodiment. In FIG. 9, a difference from the first embodiment (shown in FIG. 2) lies in that the arm cylinder 3 is replaced with the swing motor 7.

A flow passage 215 is connected to an a-port of the swing motor 7.

A flow passage 216 is connected to a b-port of the swing motor 7.

The swing motor 7 is a hydraulic motor that rotates by receiving the supply of the hydraulic operating fluid. The rotational direction of the swing motor 7 depends on the supply direction of the hydraulic operating fluid.

Relief valves 37*a* and 37*b* respectively provided to the flow passages 215 and 216 let the hydraulic operating fluid escape to the tank 25 via the charge relief valve 20 and thereby protect the circuit when flow passage pressure becomes equal to or higher than a predetermined pressure.

A flushing valve 38 provided to the flow passages 215 and 216 discharges excess oil within the flow passages to the tank 25 via the charge relief valve 20.

A pressure sensor 62*a* connected to the flow passage 215 measures the pressure of the flow passage 215, and inputs the pressure of the flow passage 215 to the controller 50. The pressure sensor 62*a* measures an a-port pressure Pswing_a of the swing motor 7 by measuring the pressure of the flow passage 215.

A pressure sensor 62*b* connected to the flow passage 216 measures the pressure of the flow passage 216, and inputs the pressure of the flow passage 216 to the controller 50. The pressure sensor 62*b* measures a b-port pressure Pswing_b of the swing motor 7 by measuring the pressure of the flow passage 216.

Figure 10:
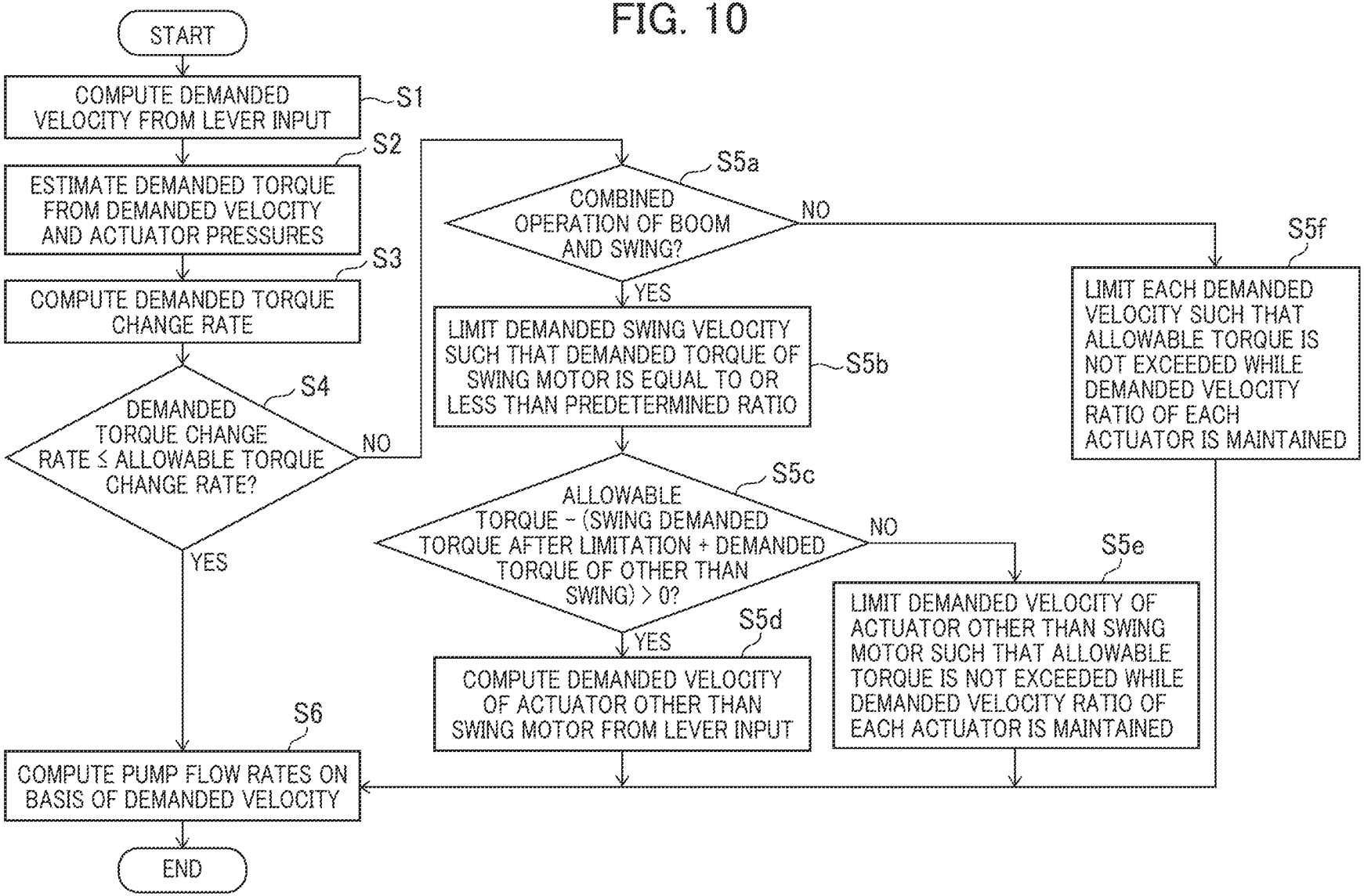
FIG. 10 is a flowchart showing processing of a controller in the second embodiment of the present invention.

FIG. 10 is a flowchart showing a flow of pump load torque control of the controller 50 shown in FIG. 9. In FIG. 10, a difference from the first embodiment (shown in FIG. 5) lies in that steps S5*a* to S5*f* are included in place of step S5. The difference will be described in the following.

In ca case in which a combined operation of the boom and a swing is performed in step S5*a*, the controller 50 proceeds to step S5*b*. The controller 50 otherwise proceeds to step S5*f*.

In step S5*b*, the controller 50 limits the demanded velocity of the swing motor 7 such that the demanded torque of the swing motor 7 is equal to or less than a predetermined ratio of a total allowable torque Tp_lim.

In a case in which a sum of the demanded torque of the swing motor 7 whose demanded velocity is limited and the demanded torque of the other actuator than the swing motor 7 exceeds the total allowable torque Tp_lim in step S5*c*, the controller 50 proceeds to step S5*d*. The controller 50 otherwise proceeds to step S5*e*.

In step S5*d*, the controller 50 determines the demanded velocity of the actuator other than the swing motor 7 from the input value Lin of the lever 51.

In step S5*e*, the controller 50 limits the demanded velocity of the actuator other than the swing motor 7 such that the sum of the demanded torques of the respective actuators is equal to or less than the total allowable torque Tp_lim while the demanded velocity ratio of each actuator is maintained.

In step S5*f*, the controller 50 limits the demanded velocities of the respective actuators such that the sum of the demanded torques of the respective actuators is equal to or less than the total allowable torque Tp_lim while the demanded velocity ratio of each actuator is maintained.

Operation of a hydraulic drive system 300A shown in FIG. 9 will next be described.

(1) During Non-Operation

In FIG. 9, when the lever 51 is not operated, the first to the fourth hydraulic pumps 12 to 15 are all controlled to a minimum tilting angle, the selector valves 40 to 44 and 46 are all closed, and the boom cylinder 1 and the swing motor 7 are maintained in a stop state.

(2) During Boom Raising and Swing Operation

Figure 11:
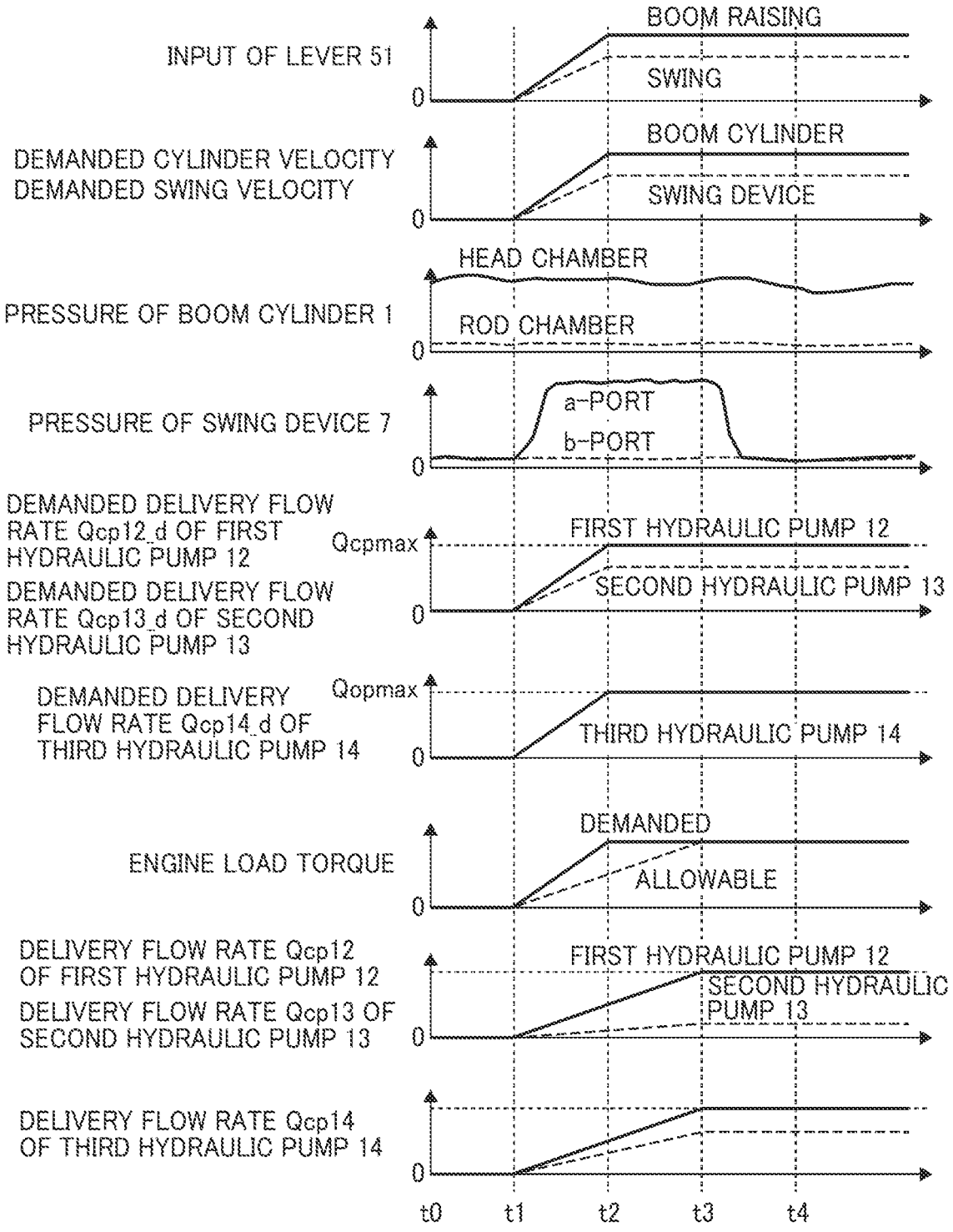
FIG. 11 is a diagram showing behavior during boom raising and swinging operation of the hydraulic drive system in the second embodiment of the present invention.

FIG. 11 shows changes in input of the lever 51, demanded cylinder velocity and demanded swing velocity based on the input of the lever 51, the head chamber pressure and the rod chamber pressure of the boom cylinder 1 which are respectively measured by the pressure sensors 60*a* and 60*b*, the a-port pressure and the b-port pressure of the swing motor 7 which are respectively measured by the pressure sensors 62*a* and 62*b*, the respective demanded delivery flow rates of the first to the third hydraulic pumps 12 to 14, the engine load torque, and the respective delivery flow rates of the first to the third hydraulic pumps 12 to 14 in a case in which the hydraulic drive system 300 simultaneously performs an expanding operation of the boom cylinder 1 and a swinging operation of the swing motor 7.

Over a period from time t0 to time t1, the input of the lever 51 is zero, and the boom cylinder 1 and the swing motor 7 are stationary.

Over a period from time t1 to time t2, a command value for expanding the boom cylinder 1 and a command value for rotating the swing motor 7 as the input of the lever 51 are increased to a maximum value.

According to the processing flow shown in FIG. 5, when the command values for the boom cylinder 1 and for rotating the swing motor 7 as the input of the lever 51 are increased to a maximum value over the period from time t1 to time t2 shown in FIG. 11, the controller 50 computes a demanded boom cylinder velocity Vcyl_boom_d and a demanded swing velocity Wswing_d from the input of the lever 51.

Here, the controller 50 assigns the first hydraulic pump 12 and the third hydraulic pump 14 to drive the boom cylinder 1, and assigns the second hydraulic pump 13 to drive the swing motor 7.

The controller 50 computes the demanded delivery flow rate Qcp12_*d* of the first hydraulic pump 12 from the demanded boom cylinder velocity Vcyl_boom_d by using Equations (2) and (4).

Here, a flow rate Qswing of a flow out of the swing motor 7 is expressed by the following equation:

[Equation 25]

$$Q_{swing}=W_{swing_d}\times D_{swing} \tag{25}$$

where Dswing is the displacement volume of the swing motor 7. The demanded delivery flow rate Qcp_d of the second hydraulic pump 13 connected to the swing motor 7 in a closed circuit manner is equal to the flow rate of a flow out of the swing motor 7. Thus, the following equation is satisfied:

[Equation 26]

$$Q_{cp_d}=Q_{swing} \tag{26}$$

The demanded delivery flow rate Qcp13_*d* of the second hydraulic pump 13 is computed by using Equations (25) and (26).

The controller 50 computes the demanded delivery flow rate Qop14_*d* of the third hydraulic pump 14 from the demanded boom cylinder velocity Vcyl_boom_d by using Equations (3) and (5).

The controller 50 computes the demanded torque Tcp12_*d* of the first hydraulic pump 12, the demanded torque Tcp13_*d* of the second hydraulic pump 13, and the demanded torque Top14_*d* of the third hydraulic pump 14 by using Equations (8) and (9) from the computed demanded flow rates, the head chamber pressure and the rod chamber pressure of the boom cylinder 1 which are respectively measured by the pressure sensors 60*a* and 60*b*, and the a-port pressure Pswing_a and the b-port pressure Pswing_a of the swing motor 7 which are respectively measured by the pressure sensors 62*a* and 62*b*. At this time, the demanded torque Tp_d is expressed by the following equation:

[Equation 27]

$$T_{p_d}=T_{cp12_d}+T_{op14_d}+T_{cp13_d} \tag{27}$$

Supposing that, as shown in FIG. 11, the allowable torque Tp_lim of the engine 9 takes a period of time t1 to time t3 to become the maximum rated torque of the engine 9 whereas the demanded torque Tp_d increases to the maximum value over a period from time t1 to time t2, the controller 50 computes a limited boom cylinder velocity Vcyl_boom_d' and a limited swing velocity Wswing_d' over the period from time t1 to time t3 such that the following equation is satisfied:

[Equation 28]

$$T_{p_lim}=T_{cp12_d}'+T_{op14_d}'+T_{cp13_d}' \tag{28}$$

Here, in a case where an ordinary construction machine performs a swinging operation on a level ground, the a-port pressure and the b-port pressure are low during a stop, and the pressure of a port on one side is increased during swing acceleration, as shown in FIG. 11. In a case in which a swing is performed at a maximum acceleration, in particular, the port pressure on the one side rises to the set pressure of the relief valves 37*a* and 37*b*. Hence, in a case where a demanded velocity is inputted such that the maximum acceleration is exceeded, when a flow rate as demanded is supplied from the pump, part of the flow rate is discharged from one of the relief valves 37*a* and 37*b* to the tank 25 and thus goes to waste.

For example, in a case in which control is performed so as to match the demanded velocity ratios of the two actuators as in the (4) boom raising and arm dumping operation of the first embodiment, the swing motor 7 may discharge a part of the flow rate from the relief valve 37*a* or 37*b*, and not only may the swing velocity not be achieved but also the velocity of the boom cylinder 1 may be decreased.

In order to suppress this, when the boom cylinder 1 and the swing motor 7 are operated in combination with each other, a ratio of horsepower assigned to the swing motor 7 is set lower than a ratio of horsepower assigned to the boom cylinder 1. That is, the swing motor 7 is assigned 50% or less (for example, 20%) of horsepower that can be outputted by the engine 9. From Equation (28), the following equation is satisfied:

[Equation 29]

$$T_{cp12_d}'+T_{op14_d}'=0.8T_{p_lim} \tag{29}$$

and the following equation is satisfied:

[Equation 30]

$$T_{cp13_d}'=0.2T_{p_lim} \tag{30}$$

From Equations (2), (7), (8), (9), (24), and (25), the following equation is satisfied:

[Equation 31]

$$T_{p_lim}=V_{cyl_boom_d}'\times A_{cyl_boom_r}\times G+W_{swing_d}'\times D_{swing}\times I \tag{31}$$

Here,

[Equation 32]

$$I=\frac{1}{N_{eng}}(P_{swing_a}-P_{swing_b}+2P_{loss})\times\eta_{cp} \tag{32}$$

From Equations (29), (30), and (31), the limited boom cylinder velocity Vcyl_boom_d' is expressed by the following equation:

[Equation 33]

$$V_{cyl_boom_d}'=\frac{0.8T_{p_lim}}{A_{cyl_boom_r}\times G} \tag{33}$$

The limited swing velocity Wswing_d' is expressed by the following equation:

[Equation 34]

$$W_{swing_d}'=\frac{0.2T_{p_lim}}{D_{swing}\times I} \tag{34}$$

The controller 50 computes the delivery flow rate Qcp12 of the first hydraulic pump 12 and the demanded delivery flow rate Qop14 of the third hydraulic pump 14 on the basis of the limited boom cylinder velocity Vcyl_boom_d', and computes the delivery flow rate Qcp13 of the second hydraulic pump 13 on the basis of the limited swing velocity Wswing_d'.

In the present embodiment, the hydraulic actuators 1 and 7 include one or more hydraulic cylinders 1 and one or more hydraulic motors 7, and in a case in which the demanded torque change rate exceeds the predetermined change rate (allowable torque change rate) in a state in which the hydraulic cylinder 1 and the hydraulic motor 7 are driven simultaneously, the command calculating section 50*e* calculates the respective delivery flow rates of the hydraulic pumps 12 to 15 such that the demanded torque of a hydraulic pump assigned to the hydraulic motor 7 is equal to or less than a predetermined ratio (for example, 20%) of the output torque of the engine 9.

According to the hydraulic excavator 100 according to the present embodiment configured as described above, it is possible to operate the hydraulic excavator 100 without lugging down the engine 9 while suppressing a significant decrease in velocity of the boom cylinder 1 as the pressure of the swing motor 7 increases at a time of a start of a swing.

Third Embodiment

A hydraulic excavator 100 according to a third embodiment of the present invention will be described centering on differences from the first embodiment.

Figure 12:
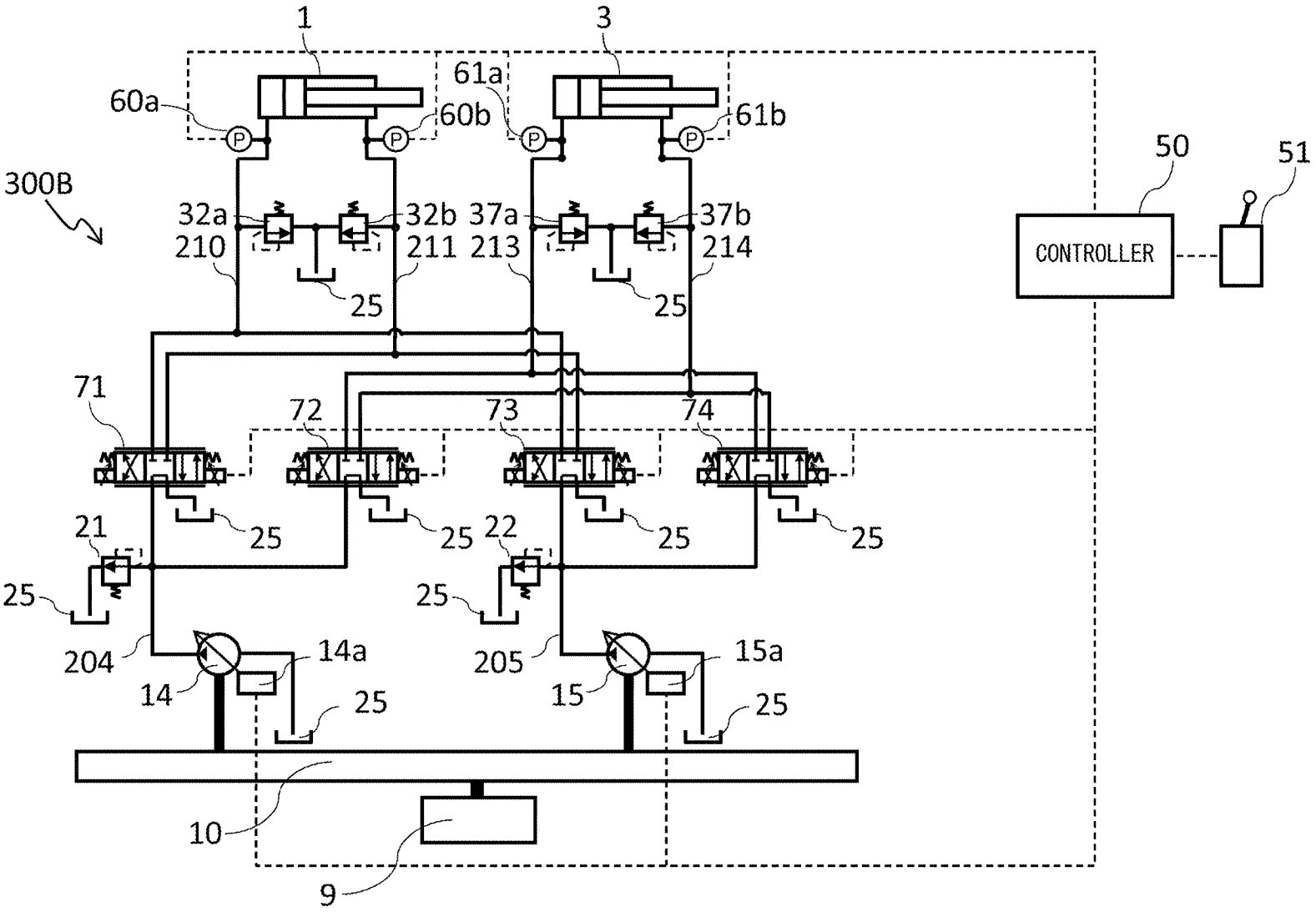
FIG. 12 is a schematic configuration diagram of a hydraulic drive system in a third embodiment of the present invention.
Figure 13:
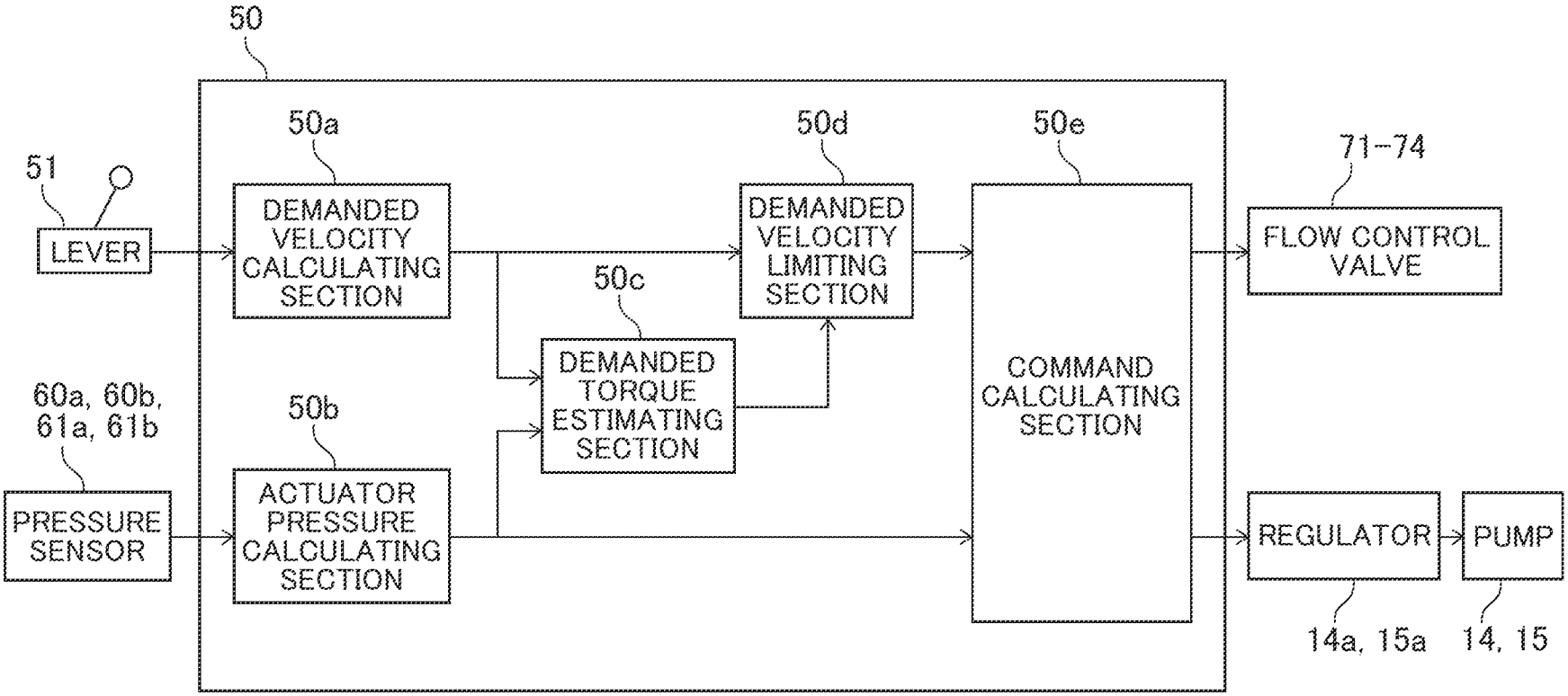
FIG. 13 is a functional block diagram of a controller in the third embodiment of the present invention.

FIG. 12 is a schematic configuration diagram of a hydraulic drive system in the present embodiment. FIG. 13 is a functional block diagram of a controller 50 in the present embodiment. In FIG. 12 and FIG. 13, differences from the first embodiment (shown in FIG. 2 and FIG. 3) lie in that constituent elements of closed circuits are removed, and in that the selector valves 44 to 47 that can change connection between the hydraulic pumps 13 and 14 and the hydraulic actuators 1 and 3 are replaced with flow control valves 71 to 74.

The flow control valve 71 is connected to the flow passage 204, the tank 25, the flow passage 210, and the flow passage 211. When no signal is inputted to the flow control valve 71, the flow control valve 72 connects the flow passage 204 and the tank 25 to each other and closes ports connected to the flow passage 210 and the flow passage 211. When a positive signal is inputted to the flow control valve 71, the flow control valve 71 connects the flow passage 204 and the flow passage 210 to each other and connects the tank 25 and the flow passage 211 to each other. In addition, when a negative signal is inputted, the flow control valve 71 connects the flow passage 204 and the flow passage 211 to each other and connects the tank 25 and the flow passage 210 to each other. The opening area of a flow passage connecting each flow passage changes according to the magnitude of the positive or negative signal.

The flow control valve 72 is connected to the flow passage 204, the tank 25, the flow passage 213, and the flow passage 214. When there is no signal to the flow control valve 72, the flow control valve 72 connects the flow passage 204 and the tank 25 to each other and closes ports connected to the flow passage 213 and the flow passage 214. When a positive signal is inputted to the flow control valve 72, the flow control valve 72 connects the flow passage 204 and the flow passage 213 to each other and connects the tank 25 and the flow passage 214 to each other. In addition, when a negative signal is inputted, the flow control valve 71 connects the flow passage 204 and the flow passage 214 to each other and connects the tank 25 and the flow passage 213 to each other. The opening area of a flow passage connecting each flow passage changes according to the magnitude of the positive or negative signal.

The flow control valve 73 is connected to the flow passage 205, the tank 25, the flow passage 210, and the flow passage 211. In a case in which no signal is inputted to the flow control valve 73, the flow control valve 73 connects the flow passage 205 and the tank 25 to each other and closes ports connected to the flow passage 210 and the flow passage 211. When a positive signal is inputted to the flow control valve 73, the flow control valve 73 connects the flow passage 205 and the flow passage 210 to each other and connects the tank 25 and the flow passage 211 to each other. In addition, when a negative signal is inputted, the flow control valve 73 connects the flow passage 205 and the flow passage 211 to each other and connects the tank 25 and the flow passage 210 to each other. The opening area of a flow passage connecting each flow passage changes according to the magnitude of the positive or negative signal.

The flow control valve 74 is connected to the flow passage 205, the tank 25, the flow passage 213, and the flow passage 214. When no signal is inputted to the flow control valve 74, the flow control valve 72 connects the flow passage 205 and the tank 25 to each other and closes ports connected to the flow passage 213 and the flow passage 214. When a positive signal is inputted to the flow control valve 74, the flow control valve 74 connects the flow passage 205 and the flow passage 213 to each other and connects the tank 25 and the flow passage 214 to each other. In addition, when a negative signal is inputted, the flow control valve 74 connects the flow passage 205 and the flow passage 214 to each other and connects the tank 25 and the flow passage 213 to each other. The opening area of a flow passage connecting each flow passage changes according to the magnitude of the positive or negative signal.

In a hydraulic drive system 300B shown in FIG. 12, when pressure losses occurring in the flow control valves 71 to 74 are estimated, it is possible to operate the hydraulic excavator 100 without lugging down the engine 9 while maintaining the demanded velocity ratio of each actuator which demanded velocity ratio is determined by the input of the lever 51, as shown in the first embodiment.

Incidentally, the pressure losses occurring in the flow control valves 71 to 74 are estimated easily when the flow control valves 71 to 74 are used with a maximum opening area and the velocities of the boom cylinder 1 and the arm cylinder 3 are controlled by the delivery flow rates of the hydraulic pumps 14 and 15.

The hydraulic excavator 100 according to the present embodiment includes the hydraulic pumps 13 and 14, the hydraulic actuators 1 and 3, and the control valves 71 to 74 capable of changing connection between the hydraulic actuators 1 and 3 and the hydraulic pumps 13 and 14, the pressure sensors 60*a*, 60*b*, 61*a*, and 61*b* can detect the respective load pressures on the hydraulic actuators 1 and 3, the operation device 51 can give instructions for the respective operation directions and the respective demanded velocities of the hydraulic actuators 1 and 3, the demanded torque estimating section 50*c* estimates the demanded torque as a sum of respective torques demanded from the engine 9 by the hydraulic pumps 13 and 14 on the basis of the respective demanded velocities and the respective load pressures on the hydraulic actuators 1 and 3, the demanded velocity limiting section 50*d* limits the respective demanded velocities of the hydraulic actuators 1 and 3 such that the demanded torque change rate as the change rate of the demanded torque is equal to or less than a predetermined change rate (allowable torque change rate) in a case in which the demanded torque change rate exceeds the predetermined change rate, and the command calculating section 50*e* determines assignment of the hydraulic pumps 13 and 14 to the hydraulic actuators 1 and 3 and calculates the respective delivery flow rates of the hydraulic pumps 13 and 14 on the basis of the respective demanded velocities of the hydraulic actuators 1 and 3, the respective demanded velocities being limited by the demanded velocity limiting section 50*d*.

In addition, the hydraulic pumps 14 and 15 are each a single-delivery type hydraulic pump having a suction port and a delivery port, and the control valves 71 to 74 capable of changing connection between the hydraulic actuators 1 and 3 and the hydraulic pumps 14 and 15 are flow control valves that can adjust the directions and flow rates of the pressure liquid supplied from the hydraulic pumps 14 and 15 to the hydraulic actuators 1 and 3.

According to the present embodiment configured as described above, the hydraulic excavator 100 including the hydraulic drive system 300B that can change connection between the hydraulic actuators 1 and 3 and the hydraulic pumps 13 and 14 by the flow control valves 71 to 74 can suppress lugging down of the engine 9 irrespective of contents of operation of the operator and the load states of the actuators 1 and 3 as in the first embodiment.

Embodiments of the present invention have been described above in detail. However, the present invention is not limited to the foregoing embodiments, but includes various modifications. For example, the foregoing embodiments have been described in detail in order to describe the present invention in an easily understandable manner, and are not necessarily limited to the embodiments including all of the described configurations. In addition, it is possible to add a part of a configuration of another embodiment to a configuration of a certain embodiment, and it is possible to omit a part of a configuration of a certain embodiment or replace a part of a configuration of a certain embodiment with a part of another embodiment.

DESCRIPTION OF REFERENCE CHARACTERS

1: Boom cylinder (hydraulic cylinder, hydraulic actuator)
1*a*: Head chamber
1*b*: Rod chamber
2: Boom
3: Arm cylinder (hydraulic cylinder, hydraulic actuator)
3*a*: Head chamber
3*b*: Rod chamber
4: Arm
5: Bucket cylinder (hydraulic cylinder, hydraulic actuator)
6: Bucket
7: Swing motor (hydraulic motor, hydraulic actuator)
8: Track device
9: Engine
10: Power transmission device
11: Charge pump
12: First hydraulic pump
12*a*: Regulator
13: Second hydraulic pump
13*a*: Regulator
14: Third hydraulic pump
14*a*: Regulator
15: Fourth hydraulic pump
15*a*: Regulator
20: Charge relief valve
21, 22: Relief valve
25: Tank
26, 27, 28*a*, 28*b*, 29*a*, 29*b*: Charge check valve
30*a*, 30*b*, 31*a*, 31*b*, 32*a*, 32*b*, 33*a*, 33*b*: Relief valve
34, 35: Flushing valve
36*a*, 36*b*: Charge check valve
37*a*, 37*b*: Relief valve
38: Flushing valve
40 to 47: Selector valve (control valve)
48, 49: Proportional valve
50: Controller
50*a*: Demanded velocity calculating section
50*b*: Actuator pressure calculating section
50*c*: Demanded torque estimating section
50*d*: Demanded velocity limiting section
50*e*: Command calculating section
51: Lever (operation device)
60*a*, 60*b*, 61*a*, 61*b*, 62*a*, 62*b*: Pressure sensor (pressure sensor)
71 to 74: Flow control valve (control valve)
100: Hydraulic excavator
101: Lower track structure
102: Upper swing structure
103: Front work device
104: Cab
200 to 216: Flow passage
300, 300A, 300B: Hydraulic drive system

The invention claimed is:

1. A construction machine comprising:

an engine;

a variable displacement first hydraulic pump driven by the engine;

a first hydraulic actuator driven by pressure liquid delivered from the first hydraulic pump;

an operation device configured to give instructions for an operation direction and a demanded velocity of the first hydraulic actuator; and a controller configured to control a delivery flow rate of the first hydraulic pump according to an input from the operation device;

wherein the construction machine comprises a pressure sensor configured to detect a load pressure on the first hydraulic actuator, and the controller includes:

a demanded torque estimating section configured to estimate demanded torque as torque demanded from the engine by the first hydraulic pump on a basis of the demanded velocity of the first hydraulic actuator and the load pressure on the first hydraulic actuator;

a demanded velocity limiting section configured to, in a case in which a demanded torque change rate as a change rate of the demanded torque exceeds a predetermined change rate, limit the demanded velocity such that the demanded torque change rate becomes equal to or lower than the predetermined change rate; and a command calculating section configured to calculate the delivery flow rate of the first hydraulic pump on a basis of the demanded velocity of the first hydraulic actuator, the demanded velocity being limited by the demanded velocity limiting section.

2. The construction machine according to claim 1, comprising:

a plurality of hydraulic pumps including the first hydraulic pump;

a plurality of hydraulic actuators including the first hydraulic actuator; and a plurality of control valves capable of changing connection between the plurality of hydraulic actuators and the plurality of hydraulic pumps, wherein the pressure sensor is able to detect respective load pressures on the plurality of hydraulic actuators, the operation device is able to give instructions for respective operation directions and respective demanded velocities of the plurality of hydraulic actuators, the demanded torque estimating section is configured to estimate the demanded torque as a sum of respective torques demanded from the engine by the plurality of hydraulic pumps on a basis of the respective demanded velocities and the respective load pressures on the plurality of hydraulic actuators, the demanded velocity limiting section is configured to, in a case in which the demanded torque change rate as the change rate of the demanded torque exceeds the predetermined change rate, limit the respective demanded velocities of the plurality of hydraulic actuators such that the demanded torque change rate becomes equal to or lower than the predetermined change rate, and the command calculating section is configured to determine assignment of the plurality of hydraulic pumps to the plurality of hydraulic actuators and calculate respective delivery flow rates of the plurality of hydraulic pumps on a basis of the respective demanded velocities of the plurality of hydraulic actuators, the respective demanded velocities being limited by the demanded velocity limiting section.

3. The construction machine according to claim 2, wherein the command calculating section is configured to reduce the number of hydraulic pumps assigned to one hydraulic actuator of the plurality of hydraulic actuators according to the demanded velocity of the one hydraulic actuator, the demanded velocity being limited by the demanded velocity limiting section, in a case in which the demanded torque change rate exceeds the predetermined change rate in a state in which two or more hydraulic pumps are assigned to the one hydraulic actuator.

4. The construction machine according to claim 2, wherein the plurality of hydraulic actuators include one or more hydraulic cylinders and one or more hydraulic motors, and the command calculating section is configured to, in a case in which the demanded torque change rate exceeds the predetermined change rate in a state in which the hydraulic cylinder and the hydraulic motor are driven simultaneously, calculate the respective delivery flow rates of the plurality of hydraulic pumps such that the demanded torque of a hydraulic pump assigned to the hydraulic motor is equal to or less than a predetermined ratio of output power torque of the engine.

5. The construction machine according to claim 4, wherein the predetermined ratio is set at equal to or less than 50%.

6. The construction machine according to claim 2, wherein the plurality of hydraulic pumps are each a double-delivery type hydraulic pump having a pair of input and output ports, and the plurality of control valves are a plurality of selector valves capable of changing connection between the plurality of hydraulic pumps and the plurality of hydraulic actuators.

7. The construction machine according to claim 2, wherein the plurality of hydraulic pumps are each a single-delivery type hydraulic pump having a suction port and a delivery port, and the plurality of control valves are a plurality of flow control valves capable of adjusting directions and flow rates of the pressure liquid supplied from the plurality of hydraulic pumps to the plurality of hydraulic actuators.

* * * * *